US007618113B2

(12) United States Patent
Fukasawa et al.

(10) Patent No.: US 7,618,113 B2
(45) Date of Patent: Nov. 17, 2009

(54) LIQUID DISCHARGE APPARATUS AND LIQUID DISCHARGE METHOD

(75) Inventors: Kenji Fukasawa, Matsumoto (JP); Tsuneo Kasai, Azumino (JP); Hirokazu Kasahara, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 12/140,109

(22) Filed: Jun. 16, 2008

(65) Prior Publication Data

US 2008/0316238 A1 Dec. 25, 2008

(30) Foreign Application Priority Data

Jun. 19, 2007 (JP) ..... 2007-161774

(51) Int. Cl.
*B41J 2/205* (2006.01)

(52) U.S. Cl. ..... 347/15; 347/43

(58) Field of Classification Search ..... 347/12, 347/13, 15, 40, 42, 43, 44, 47
See application file for complete search history.

(56) References Cited

U.S. PATENT DOCUMENTS 6,659,583 B2 * 12/2003 Fujimori ..... 347/15

FOREIGN PATENT DOCUMENTS

JP 2007-068202 3/2007

* cited by examiner

*Primary Examiner*—Juanita D Stephens
(74) *Attorney, Agent, or Firm*—Hogan & Hartson LLP

(57) ABSTRACT

A liquid discharge apparatus. Each of a plurality of first nozzle rows includes a plurality of nozzles disposed in a predetermined direction that discharge cyan or magenta liquid. Each of a plurality of second nozzle rows includes a plurality of nozzles disposed in the predetermined direction that discharge yellow liquid. The number of second nozzle rows is smaller than the number of first nozzle rows. The first nozzle rows form cyan or magenta dots at pixels on a medium. The second nozzle rows form yellow dots at pixels whose number is smaller than the number of pixels at which the first dots are formed.

14 Claims, 22 Drawing Sheets

FIG. 5A
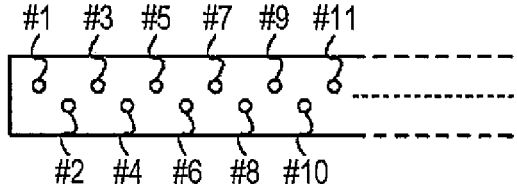
FIG. 5B
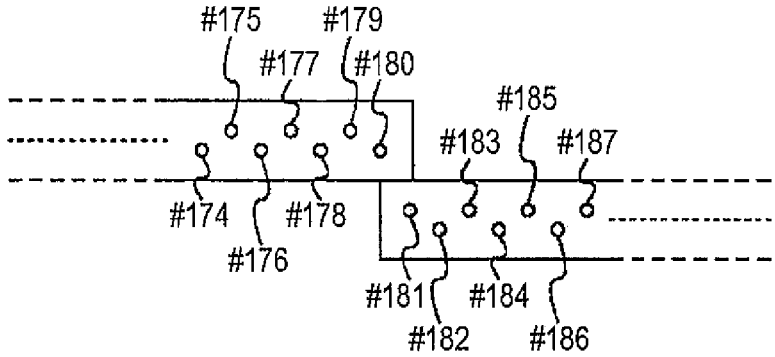
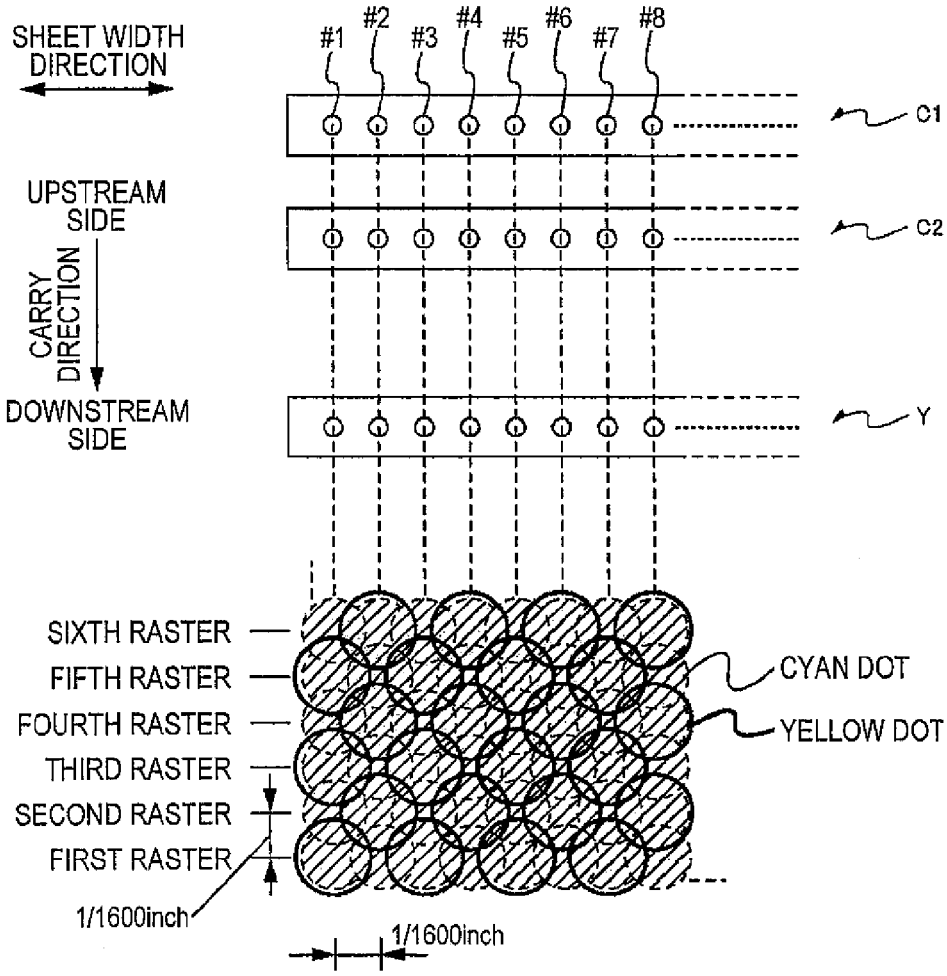
FIG. 6

LIQUID DISCHARGE APPARATUS AND LIQUID DISCHARGE METHOD

CROSS REFERENCE TO RELATED APPLICATIONS

This application claims the benefit under 35 USC 119 of Japanese patent application number 2007-161774, filed in Japan on Jun. 19, 2007.

BACKGROUND

1. Technical Field

The present invention relates to a liquid discharge apparatus and a liquid discharge method.

2. Related Art

Inkjet printers are known as liquid discharge apparatuses that discharge liquid (ink, for example) onto a medium (a sheet of paper, a piece of fabric, or an OHP sheet, for example). In an inkjet printer, a dot formation process in which a carriage is moved and ink droplets are discharged from a head and a carry process in which a sheet of paper is carried are alternately repeated so that an image formed of dots is printed on the sheet of paper. One type of inkjet printer called a line printer does not use the carriage to move the head but uses a head having a length equal to the width of a sheet of paper (see JP-A-2007-68202).

To enhance image quality, dots must be formed at high resolution so that the dot-to-dot distance is small. To form dots at a large number of pixels at high resolution, a plurality of nozzle rows that discharge ink of the same color may be used.

Increase in the number of nozzle rows, however, increases manufacturing cost.

SUMMARY

An advantage of the present invention is to reduce the number of nozzle rows.

According to one aspect of the invention, a liquid discharge apparatus includes (1) a plurality of first nozzle rows, each including a plurality of nozzles disposed in a predetermined direction that discharge cyan or magenta first liquid, (2) second nozzle rows, each including a plurality of nozzles disposed in the predetermined direction that discharge yellow second liquid, the number of second nozzle rows being smaller than the number of first nozzle rows, and (3) a controller that uses the plurality of first nozzle rows to form cyan or magenta first dots at pixels on a medium and uses the second nozzle rows to form yellow second dots at pixels whose number is smaller than the number of pixels at which the first dots have been formed.

According to such a liquid discharge apparatus, the number of nozzle rows is reduced.

In the liquid discharge apparatus, when a certain nozzle discharges liquid, the nozzles adjacent to the certain nozzle preferably do not discharge liquid. With such a configuration, when a certain nozzle discharges liquid, the liquid discharge operation is not affected by adjacent nozzles.

In the liquid discharge apparatus, after a certain nozzle has formed a dot at a pixel, the nozzle preferably does not form a dot at a pixel that the nozzle next faces. With such a configuration, the printing speed is faster.

In the liquid discharge apparatus, the plurality of first nozzle rows preferably include two first nozzle rows. After one of the first nozzle rows has formed corresponding first dots, the other first nozzle row forms corresponding first dots.

The second nozzle rows form second dots at pixels at which the one of the first nozzle rows has formed the corresponding first dots, and form no second dots at pixels at which the other first nozzle row has formed the corresponding first dots. With such a configuration, blurring will not occur.

In the liquid discharge apparatus, the second dot is preferably larger than the first dot. With such a configuration, the second liquid, which is placed only at a smaller number of pixels, is more easily applied to a large area of the medium.

Another aspect of the invention provides a liquid discharge apparatus including (1) a plurality of cyan nozzle rows, each including a plurality of nozzles disposed in a predetermined direction that discharge cyan ink, (2) a plurality of magenta nozzle rows, each including a plurality of nozzles disposed in the predetermined direction that discharge magenta ink, (3) yellow nozzle rows, each including a plurality of nozzles disposed in the predetermined direction that discharge yellow ink, the number of yellow nozzle rows being smaller than the number of cyan nozzle rows and the number of magenta nozzle rows, and (4) a controller that uses the plurality of cyan nozzle rows to form cyan dots at pixels on a medium, uses the plurality of magenta nozzle rows to form magenta dots at pixels on the medium, and uses the yellow nozzle rows to form yellow dots at pixels whose number is smaller than the number of pixels at which the cyan dots have been formed and the number of pixels at which the magenta dots have been formed.

According to such a liquid discharge apparatus, the number of nozzle rows is reduced.

Another aspect of the invention is a liquid discharge method that includes discharging cyan or magenta first liquid from first nozzle rows, each including a plurality of nozzles disposed in a predetermined direction, discharging yellow second liquid from second nozzle rows, each including a plurality of nozzles disposed in the predetermined direction, using the plurality of first nozzle rows to form cyan or magenta first dots at pixels on a medium, and using the second nozzle rows, the number of which is smaller than the number of first nozzle rows, to form yellow second dots at pixels whose number is smaller than the number of pixels at which the first dots have been formed.

According to such a liquid discharge method, the number of nozzle rows is reduced.

BRIEF DESCRIPTION OF THE DRAWINGS

The invention is now described with reference to the accompanying drawings, wherein like numbers refer to like elements.

FIGS. 5A and 5B are explanatory diagrams of an arrangement of nozzles.

FIG. 6 is an explanatory diagram of a dot forming method according to a first embodiment of the invention.

DESCRIPTION OF EXEMPLARY EMBODIMENTS

Configuration of Printing System

An embodiment of a printing system is now described with reference to the drawings. The following description includes embodiments of a computer program and a recording medium on which the computer program is recorded.

Figure 1:
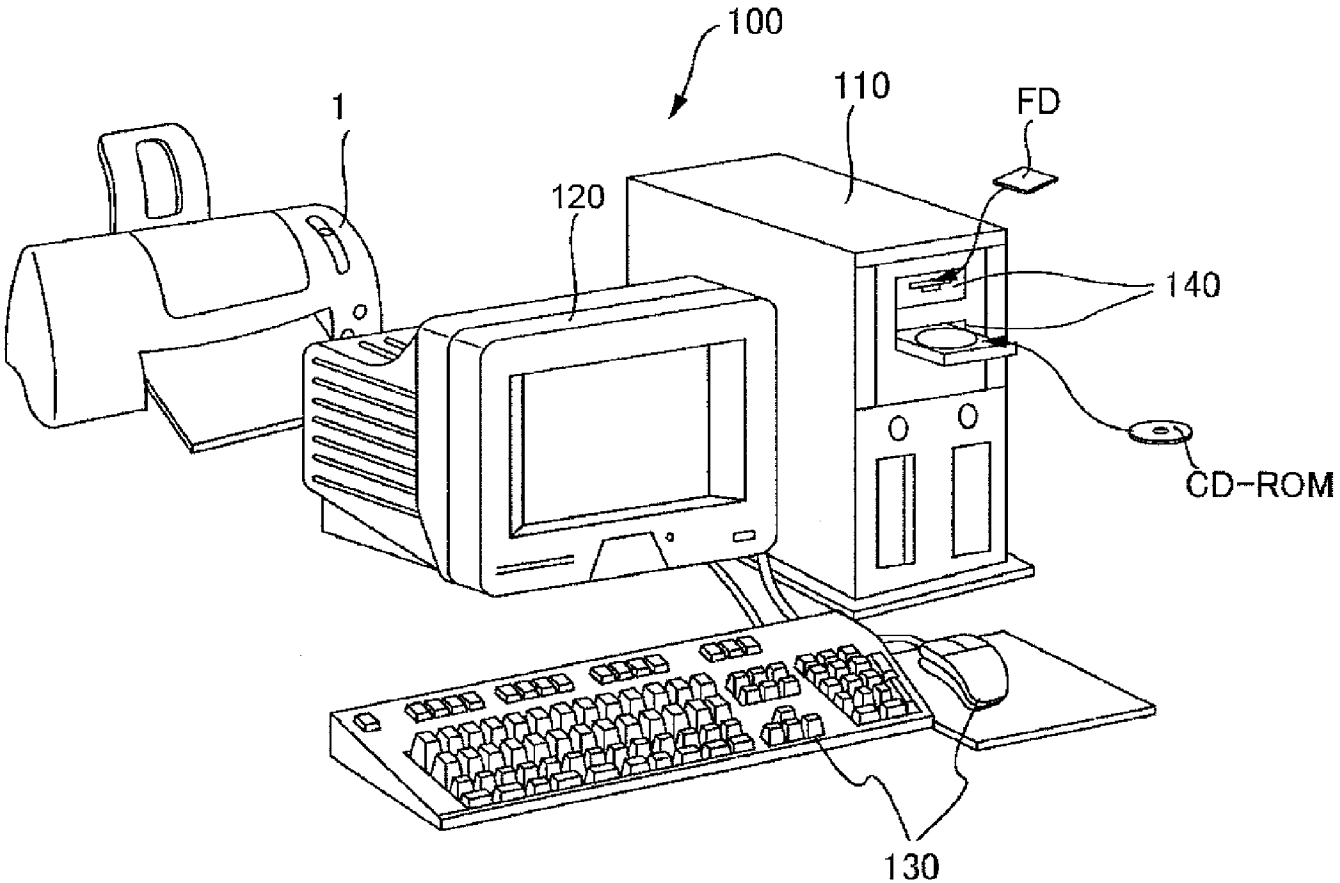
FIG. 1 is a perspective view of a printing system according to the present invention.

FIG. 1 is a perspective view of a printing system 100. The printing system 100 includes a printer 1, a computer 110, a display 120, an input apparatus 130, and a recording/reproducing apparatus 140. The printer 1 is a printing apparatus that prints an image on a medium made of, for example, paper, fabric or film. The computer 110 is communicably connected to the printer 1. The computer 110 outputs printing data according to an image to be printed to the printer 1.

A printer driver is installed in the computer 110. The printer driver is a program that displays a user interface on the display 120 and converts image data outputted from an application program into printing data. The printer driver is recorded on a computer readable recording medium such as a flexible disk FD or a CD-ROM. Alternatively, the printer driver can be downloaded to the computer 110 via the Internet. The program includes codes to perform various functions.

In this text, a "printing apparatus" means an apparatus that prints an image on a medium, and corresponds to, for example, the printer 1. A "print control apparatus" means an apparatus that controls the printing apparatus, and corresponds to, for example, a computer in which a printer driver is installed. A "printing system" means a system including at least the printing apparatus and the print control apparatus.

Configuration of Printer

Configuration of Ink Jet Printer

Figure 2:
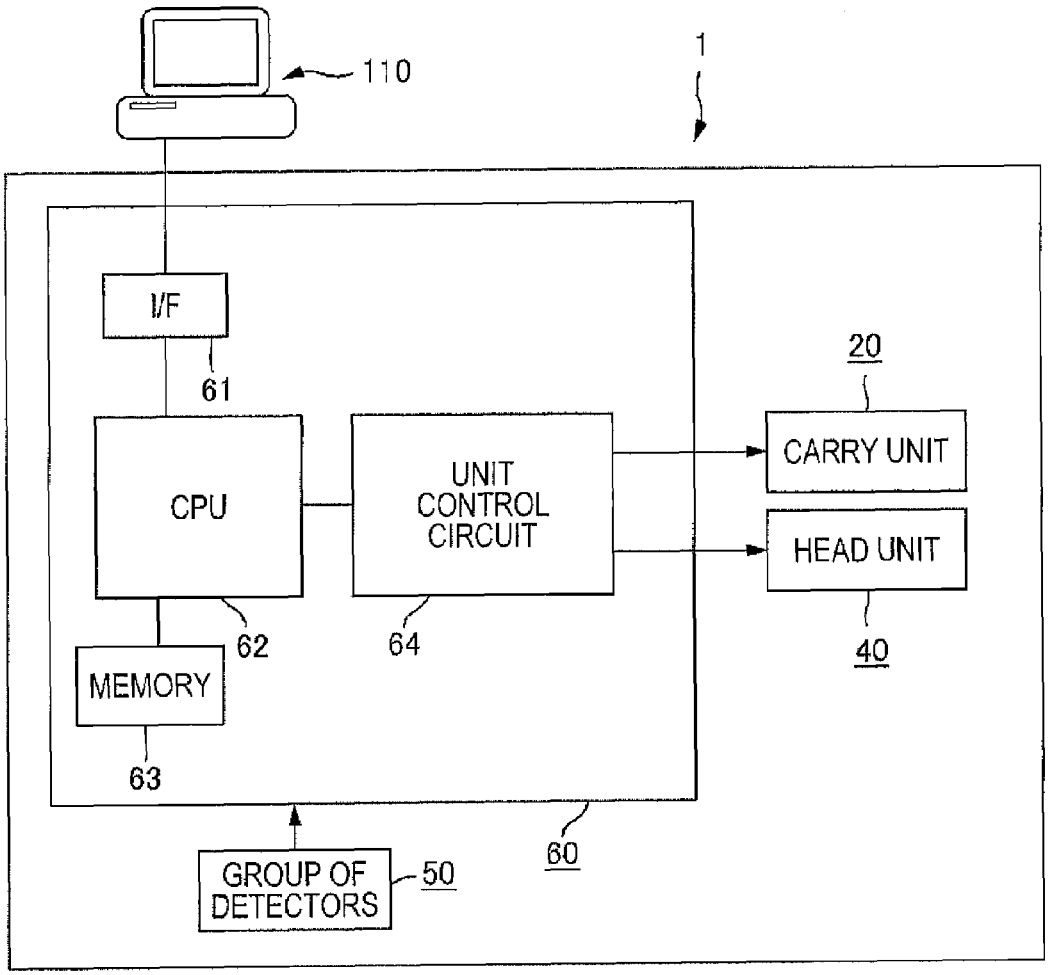
FIG. 2 is a block diagram of a printer according to the present invention.
Figure 3A:
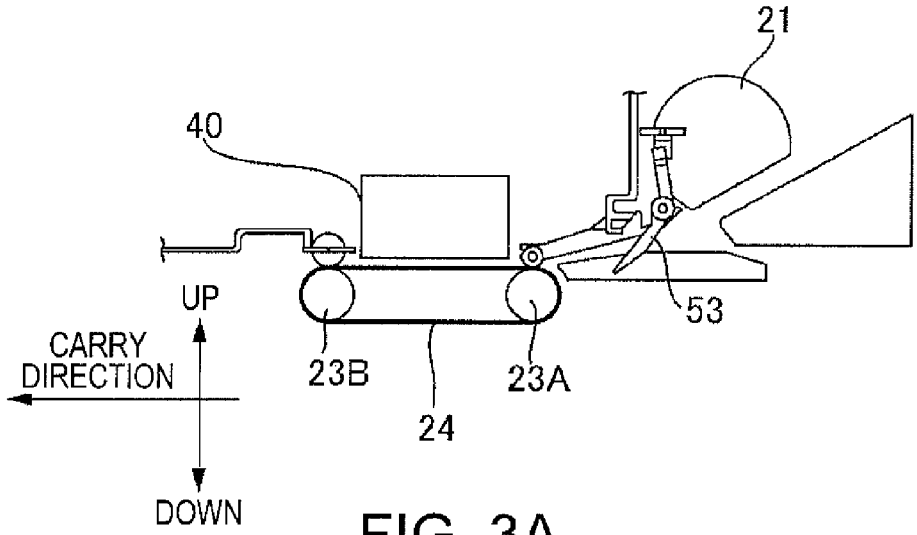
FIG. 3A is a cross-sectional view of the printer.
Figure 3B:
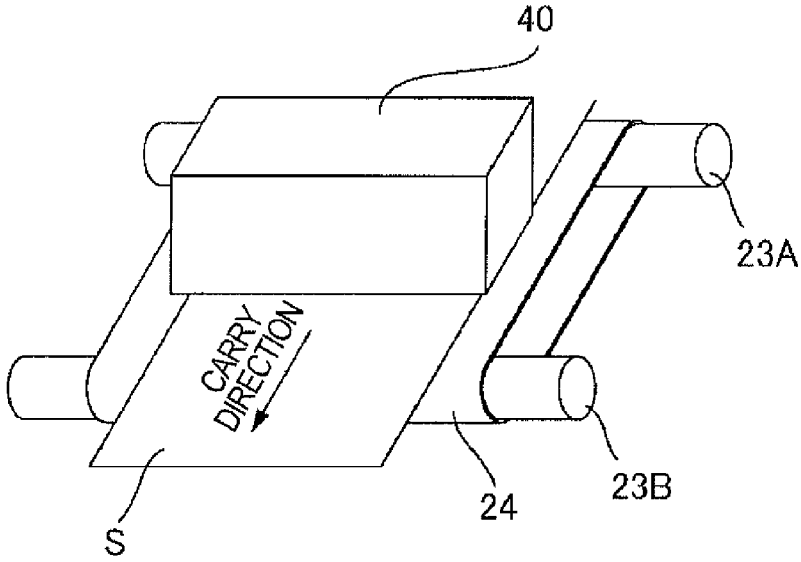
FIG. 3B is a perspective view for explaining a carry process and a dot formation process performed by the printer.

FIG. 2 is a block diagram of the printer 1. FIG. 3A is a cross-sectional view of the printer 1. FIG. 3B is a perspective view for explaining the carry process and the dot formation process performed by the printer 1. A basic configuration of a line printer, which is the printer in this embodiment, is described below.

The printer 1 includes a carry unit 20, a head unit 40, a group of detectors 50, and a controller 60. Having received printing data from the computer 110, which is an external apparatus, the printer 1 controls the carry unit 20 and the head unit 40 via the controller 60. The controller 60 controls these units based on the printing data received from the computer 110 to print an image on a sheet of paper. Various statuses of the printer 1 are monitored by the group of detectors 50, which output detection results to the controller 60. The controller 60 controls the carry unit 20 and the head unit 40 based on the detection results outputted from the group of detectors 50.

The carry unit 20 carries a medium (a sheet of paper S, for example) in a predetermined direction (hereinafter referred to as a carry direction). The carry unit 20 includes a sheet feed roller 21, a carry motor (not shown), an upstream carry roller 23A, a downstream carry roller 23B, and a belt 24. The sheet feed roller 21 feeds a sheet of paper that has been inserted into a sheet insertion slot into the printer. When the carry motor rotates, the upstream carry roller 23A and the downstream carry roller 23B rotate and hence the belt 24 rotates. The sheet of paper S fed by the sheet feed roller 21 is carried by the belt 24 to a printable area (the area facing the head). When the belt 24 carries the sheet of paper S, the sheet of paper S moves relative to the head unit 40 in the carry direction. The sheet of paper S that has passed through the printable area is ejected to the outside by the belt 24. The sheet of paper S that is carried is electrostatically attached to the belt 24 or vacuum-attached thereto.

The head unit 40 discharges ink onto the sheet of paper S. The head unit 40 forms dots on the sheet of paper S to print an image thereon by discharging ink onto the sheet of paper S being carried. The printer in this embodiment is a line printer, so that the head unit 40 can form dots across the width of the sheet at the same time. The configuration of the head unit 40 is described later.

The group of detectors 50 includes a rotary encoder (not shown) and a sheet detection sensor 53. The rotary encoder 53 detects the amount of rotation of the upstream carry roller 23A and the downstream carry roller 23B. The travel of the sheet of paper S can be calculated based on the detection result sent from the rotary encoder 53. The sheet detection sensor 53 detects the position of the front end of the sheet of paper being carried.

The controller 60 is a control unit (control section) that controls the printer. The controller 60 includes an interface 61, a CPU 62, a memory 63, and a unit control circuit 64. The interface 61 is responsible for data communication between the computer 110, which is an external apparatus, and the printer 1. The CPU 62 is an arithmetic processing unit that controls the entire printer. The memory 63 reserves an area that stores a program used by the CPU 62, a work area for the CPU 62, and the like. The memory 63 includes storage elements, such as a RAM and an EEPROM. The CPU 62 controls the units described above via the unit control circuit 64 according to the program stored in the memory 63. In particular, the controller 60 controls the carry operation performed by the carry unit 20 and the ink discharge operation (dot formation operation) performed by the head unit 40 to form dots in a dot arrangement described later.

Configuration of Head Unit 40

Figure 4A:
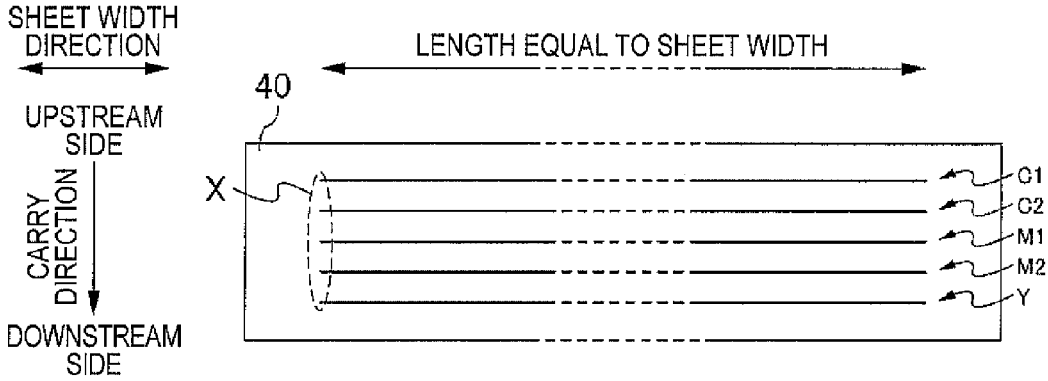
FIG. 4A is a top perspective view for explaining the arrangement of a plurality of nozzle rows located on the underside of a head unit of the printer.

FIG. 4A is a top perspective view of an arrangement of a plurality of nozzle rows located on the underside of the head unit 40. Five nozzle rows are provided on the underside of the head unit 40. The five nozzle rows include a first cyan nozzle row (C1), a second cyan nozzle row (C2), a first magenta nozzle row (M1), a second magenta nozzle row (M2), and a yellow nozzle row (Y) disposed in this order from the upstream side in the carry direction. The length of each of the nozzle rows in the sheet width direction is equal to the width of an A4-size sheet.

Figure 4B:
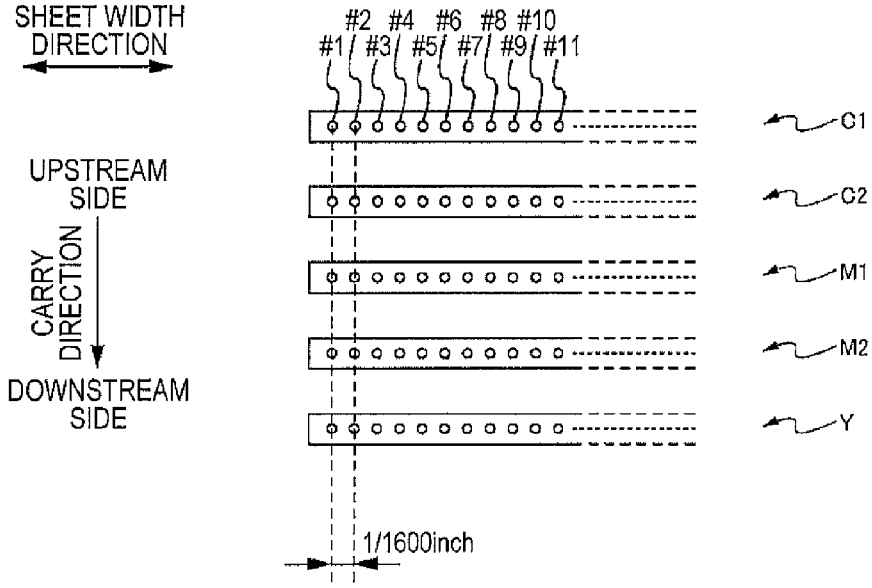
FIG. 4B is an enlarged view of the portion X encircled by the dotted line in FIG. 4A, which shows the left ends of the nozzle rows for respective colors.

FIG. 4B is an enlarged view of the portion X encircled by the dotted line in FIG. 4A, which shows the left ends of the nozzle rows for the respective colors. As shown in FIG. 4B, each of the nozzle rows has a plurality of nozzles at a predetermined nozzle pitch (1/1600 inch in this embodiment) along the sheet width direction. Each of the nozzles has a heater (not shown), and the heat generated in the heater causes ink to be discharged from the nozzle. In FIG. 4B, the nozzles in each of the nozzle rows are sequentially numbered from the left. As shown in FIG. 4B, the nozzles #1 in the nozzle rows for the respective colors are aligned in the sheet width direction. The other sets of nozzles having the same number are also aligned in the sheet width direction.

FIGS. 5A and 5B explain the arrangement of the nozzles.

To increase the printing resolution, the nozzle pitch is desirably small. However, the distance between adjacent nozzles cannot be set to a small value in some cases because of design restrictions. In view of such restrictions, the nozzles may be arranged in a staggered pattern as shown in FIG. 5A. To simplify the following description, the nozzles arranged in a staggered pattern shown in FIG. 5A will be regarded as if they were aligned as shown in FIG. 4B.

In a line printer, each nozzle row needs to have a length equal to the width of a sheet of paper. On the other hand, the length of the nozzle row cannot be set to a large value in some cases because of design restrictions. In view of such restrictions, as shown in FIG. 5B, a plurality of nozzle rows may be concatenated to form a single nozzle row having a length equal to the width of a sheet of paper. To simplify the following description, the nozzle rows concatenated as shown in FIG. 5B will be regarded as if the nozzles are aligned as shown in FIG. 4B.

Restrictions Imposed by Crosstalk Between Nozzles

In the nozzle row in this embodiment, the nozzles are formed at a nozzle pitch as small as 1/1600 inch. In this case, when ink is supplied through a common supply path to a large number of nozzles in the nozzle row, the ink discharge action of a certain nozzle may affect the ink discharge actions of the nozzles adjacent (adjacent nozzles) to the certain nozzle. For example, the ink discharge action of the nozzle #2 affects the ink discharge actions of the nozzles #1 and #3. The reason of this is believed to be variation in ink pressure in the nozzle #2 when the nozzle #2 discharges ink and subsequent transmission of the pressure variation to the nozzles #1 and #3. It is also believed that the supply of ink to the nozzle #2 affects the supply of ink to the nozzles #1 and #3. Such interaction between adjacent nozzles is called "crosstalk between nozzles."

The crosstalk between nozzles could vary the amount of ink discharged from a nozzle depending on whether or not the adjacent nozzles discharge ink at the same time. For example, although the nozzle #2 may discharge an ideally sized ink droplet when the nozzle #1 and/or #3 does not discharge ink, the nozzle #2 could discharge a smaller ink droplet when the nozzle #1 and/or #3 discharges ink at the same time.

To overcome such a problem, in the first embodiment, when a nozzle discharges ink, the adjacent nozzles are restricted not to discharge ink.

Dot Formation Method in First Embodiment

Cyan and Yellow

Figure 7A:
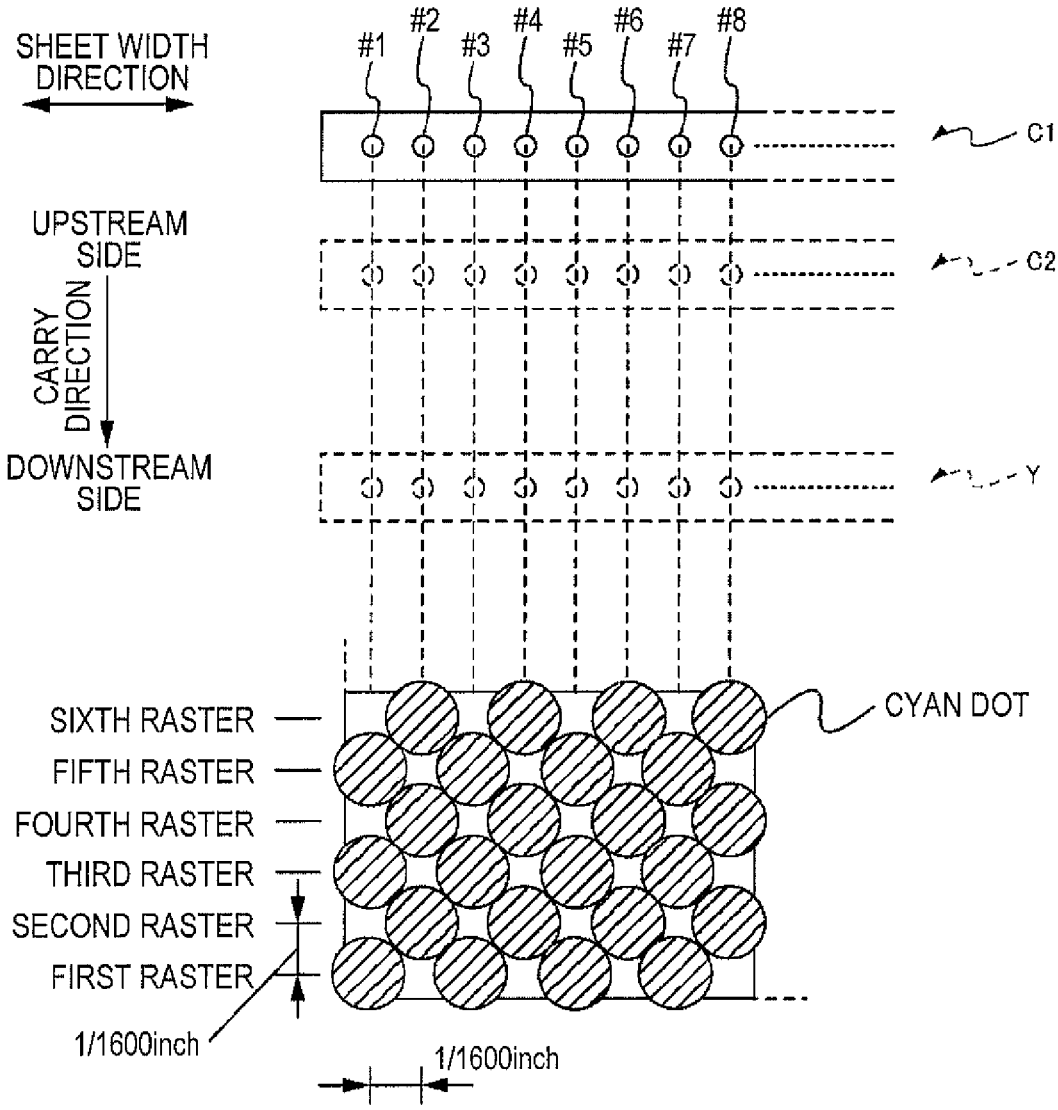
FIG. 7A is an explanatory diagram of a cyan dot forming method with a first cyan nozzle row in the first embodiment.
Figure 7B:
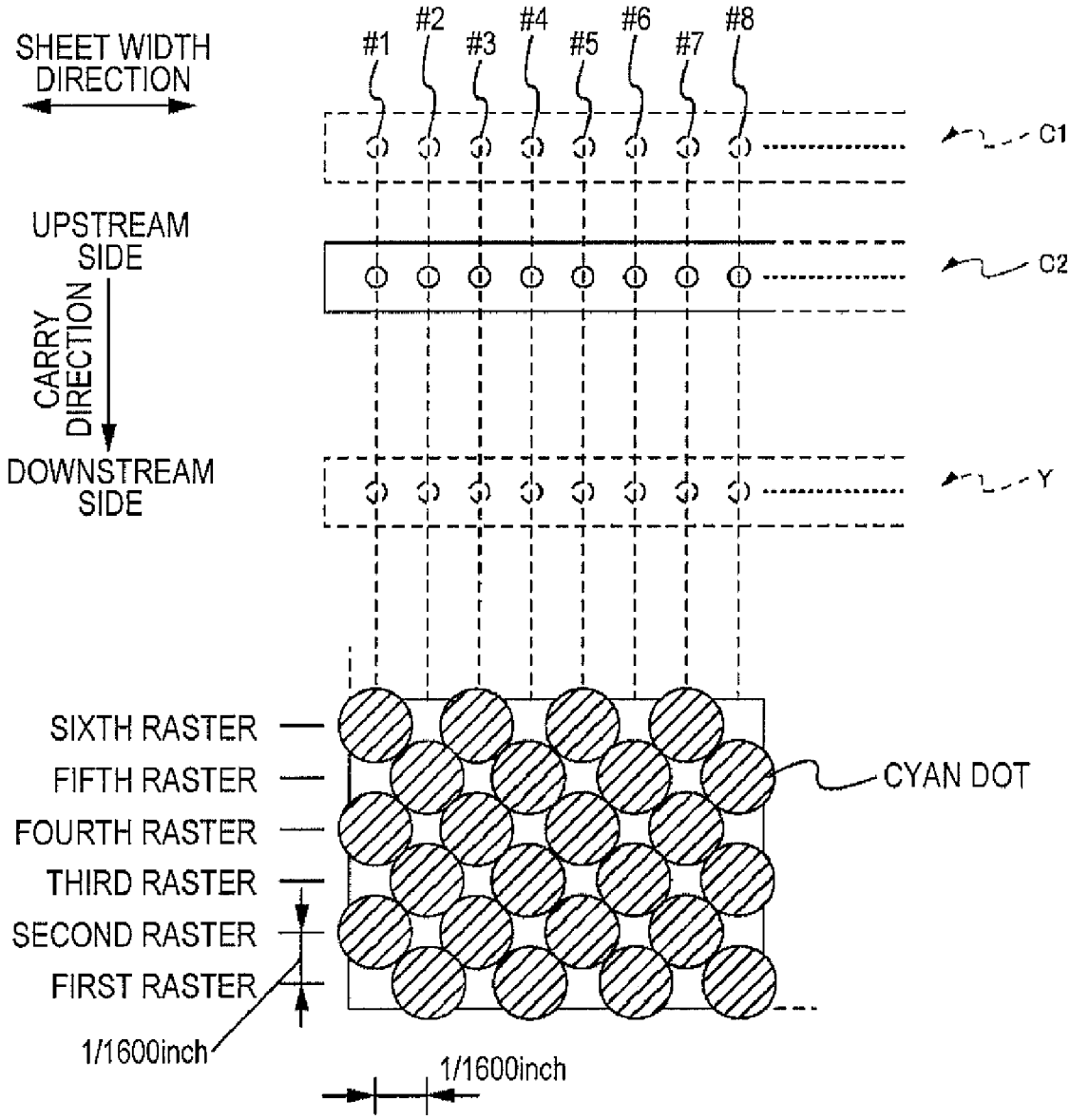
FIG. 7B is an explanatory diagram of a cyan dot forming method with a second cyan nozzle row in the first embodiment.
Figure 7C:
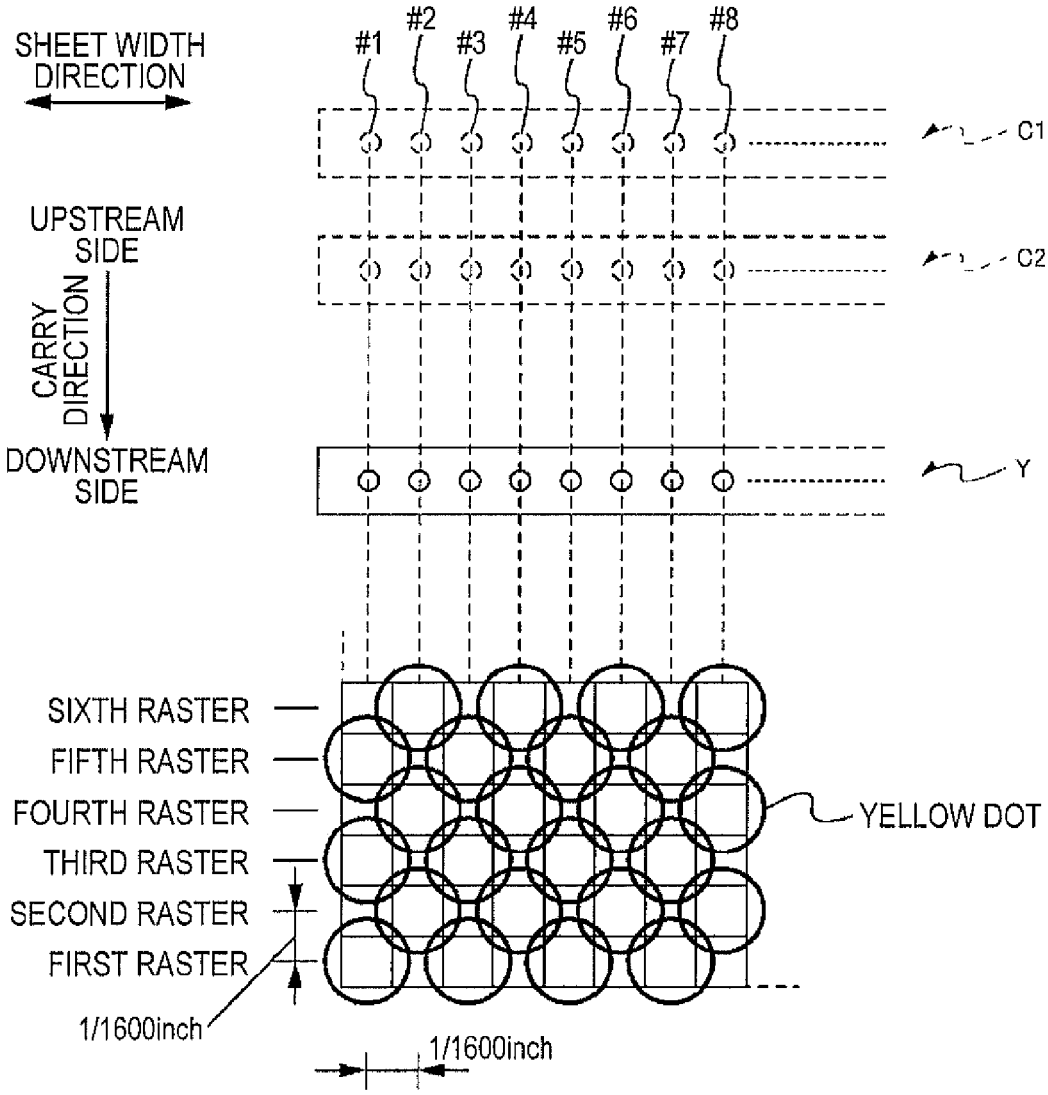
FIG. 7C is an explanatory diagram of a yellow dot forming method with a yellow nozzle row in the first embodiment.

FIG. 6 explains how to form dots in the first embodiment. FIG. 7A explains how to use the first cyan nozzle row to form cyan dots in the first embodiment. FIG. 7B explains how to use the second cyan nozzle row to form cyan dots in the first embodiment. FIG. 7C explains how to use the yellow nozzle row to form yellow dots in the first embodiment. The following description focuses on cyan and yellow, and a description of the magenta nozzle rows is omitted.

The upper part of each of the figures shows the first cyan nozzle row (C1), the second cyan nozzle row (C2), and the yellow nozzle row (Y). As shown in the figures, the number of yellow nozzle rows is smaller than the number of cyan nozzle rows in this embodiment.

The lower part of each of the figures shows the dots formed at the pixels arranged in a square grid. The hatched dots represent cyan dots. The contour of each cyan dot in FIG. 6 is drawn by a dotted line for clarity, whereas the contour of each cyan dot in FIGS. 7A and 7B is drawn by a solid line. The cyan dots are formed with cyan ink discharged from the cyan nozzle rows. The unhatched dot drawn by a thick, solid contour represents a yellow dot. The yellow dots are formed with yellow ink discharged from the yellow nozzle row. A cyan dot and a yellow dot overlap each other as described later, so that a yellow dot drawn by a solid line overlaps a hatched cyan dot in FIG. 6.

For the sake of description of the dot arrangement, the largest number of dots are formed in each of the figures. When the dots are formed as shown in the figures, the cyan grayscale (density) expressed by the cyan dots is the darkest grayscale, and the yellow grayscale expressed by the yellow dots is also the darkest grayscale. In practice, the cyan and yellow grayscales are different according to the image to be printed, and some of the dots may not be formed depending on the actual cyan and yellow grayscales.

Formation of the dots along the sheet width direction (raster) is now described.

As shown in FIG. 7A, when the first cyan nozzle row (C1) faces an odd-numbered raster, cyan ink is discharged from the odd-numbered nozzles in the first cyan nozzle row, so that cyan dots are formed at the odd-numbered pixels. For example, when the first cyan nozzle row (C1) faces the first raster, cyan ink is discharged from the odd-numbered nozzles #1, #3, #5, . . . , so that cyan dots are formed at the odd-numbered pixels. When the first cyan nozzle row (C1) faces an even-numbered raster, cyan ink is discharged from the even-numbered nozzles in the first cyan nozzle row, so that cyan dots are formed at the even-numbered pixels. For example, when the first cyan nozzle row (C1) faces the pixels in the second raster, cyan ink is discharged from the even-numbered nozzles #2, #4, #6, . . . , so that cyan dots are formed at the even-numbered pixels. In this way, cyan ink is discharged from either the set of odd-numbered nozzles or the set of even-numbered nozzles, whereas no cyan ink is discharged from the other set of nozzles, so that no ink is discharged from adjacent nozzles. The problem of crosstalk between nozzles will therefore not occur.

As shown in FIG. 7B, when the second cyan nozzle row (C2) faces an odd-numbered raster, cyan ink is discharged from the even-numbered nozzles in the second cyan nozzle row, so that cyan dots are formed at the even-numbered pixels. For example, when the second cyan nozzle row (C2) faces the first raster, cyan ink is discharged from the even-numbered nozzles #2, #4, #6, . . . , so that cyan dots are formed at the even-numbered pixels. When the second cyan nozzle row (C2) faces an even-numbered raster, cyan ink is discharged from the odd-numbered nozzles in the second cyan nozzle row, so that cyan dots are formed at the odd-numbered pixels. For example, when the second cyan nozzle row (C2) faces the pixels in the second raster, cyan ink is discharged from the odd-numbered nozzles #1, #3, #5, . . . , so that cyan dots are formed at the odd-numbered pixels. In this way, cyan ink is discharged from either the set of even-numbered nozzles or the set of odd-numbered nozzles, whereas no cyan ink is discharged from the other set of nozzles, so that no ink is discharged from adjacent nozzles. The problem of crosstalk between nozzles will therefore not occur.

As shown in FIG. 7C, when the yellow nozzle row (Y) faces an odd-numbered raster, yellow ink is discharged from the odd-numbered nozzles in the yellow nozzle row, so that yellow dots are formed at the odd-numbered pixels. For example, when the yellow nozzle row (Y) faces the pixels in the first raster, yellow ink is discharged from the odd-numbered nozzles #1, #3, #5, . . . , so that yellow dots are formed at the odd-numbered pixels. When the yellow nozzle row (Y) faces an even-numbered raster, yellow ink is discharged from the even-numbered nozzles in the yellow nozzle row, so that yellow dots are formed at the even-numbered pixels. For example, when the yellow nozzle row (Y) faces the pixels in the second raster, yellow ink is discharged from the even-numbered nozzles #2, #4, #6, . . . , so that yellow dots are formed at the even-numbered pixels. That is, the yellow nozzle row (Y) forms yellow dots in the same arrangement as that of the cyan dots formed by the first cyan nozzle row (C1). In the yellow nozzle row as well, yellow ink is discharged from either the set of odd-numbered nozzles or the set of even-numbered nozzles, whereas no yellow ink is discharged from the other set of nozzles, so that no ink is discharged from adjacent nozzles. The problem of crosstalk between nozzles will therefore not occur.

Now, consider cyan dots disposed along the sheet width direction. To form the dots in a certain raster (to form dots along the sheet width direction), the first cyan nozzle row (C1) disables either the even-numbered nozzles or the odd-numbered nozzles and forms cyan dots at every other pixel in the sheet width direction. On the other hand, the second cyan nozzle row (C2) disables either the odd-numbered nozzles or the even-numbered nozzles and forms cyan dots at every other pixel in the sheet width direction in such a way that the cyan dots are interleaved between the cyan dots that have been formed by the first cyan nozzle row at every other pixel in the sheet width direction. In this way, the cyan dots formed by the first cyan nozzle row (C1) and the cyan dots formed by the second cyan nozzle row (C2) are alternately disposed in the sheet width direction, so that cyan ink can be applied without any gap. If the cyan dots formed by the first cyan nozzle row (C1) and the cyan dots formed by the second cyan nozzle row (C2) are formed in such a way that they are superimposed on the same respective pixels, there will be gaps where no cyan ink is applied, so that the surface of paper will likely be visible even when it is intended to fill the sheet only with cyan.

Next, consider the relationship between cyan dots and yellow dots disposed in the sheet width direction. As seen from FIGS. 7A and 7C, yellow dots are formed in such a way that they are superimposed on the cyan dots that have been formed by the first cyan nozzle row (C1). The reason for this is explained below. Since the first cyan nozzle row (C1) is disposed upstream of the second cyan nozzle row (C2) in the carry direction, the first cyan nozzle row (C1) forms cyan dots earlier than the second cyan nozzle row (C2). Therefore, when the yellow nozzle row faces pixels at which cyan dots have been formed, the ink of the cyan dots formed by the first cyan nozzle row (C1) has been more absorbed in the sheet of paper and hence more dried than the ink of the cyan dots formed by the second cyan nozzle row (C2). In this embodiment, the yellow dots are formed in such a way that they are superimposed on the cyan dots that have been formed by the first cyan nozzle row (C1) by considering which row of cyan dots is more dried. If the yellow dots are formed in such a way that they are not superimposed on the cyan dots that have been formed by the first cyan nozzle row (C1) but on the cyan dots that have been formed by the second cyan nozzle row (C2), the ink will likely be blurred.

Next, formation of dots disposed in the carry direction is described.

As shown in FIG. 7A, an odd-numbered nozzle in the first cyan nozzle row (C1) discharges cyan ink whenever it faces odd-numbered rasters and forms cyan dots at every other pixel in the carry direction. For example, the nozzle #1 discharges cyan ink whenever it faces the first, third, fifth, . . . rasters, and forms cyan dots at every other pixel in the carry direction. In this way, an odd-numbered nozzle in the first cyan nozzle row (C1) forms cyan dots at pixels in the odd-numbered rasters, but does not form dots at pixels in the even-numbered rasters that the first cyan nozzle row (C1) next faces. On the other hand, an even-numbered nozzle in the first cyan nozzle row (C1) discharges cyan ink whenever it faces even-numbered rasters and forms cyan dots at every other pixel in the carry direction. For example, the nozzle #2 discharges cyan ink whenever it faces the second, fourth, sixth, . . . rasters, and forms cyan dots at every other pixel in the carry direction. In this way, an even-numbered nozzle in the first cyan nozzle row (C1) forms a cyan dot at the corresponding pixel in an even-numbered raster, but does not form a dot at the corresponding pixel in the odd-numbered raster that the first cyan nozzle row (C1) next faces.

As shown in FIG. 7B, an odd-numbered nozzle in the second cyan nozzle row (C2) discharges cyan ink whenever it faces even-numbered rasters and forms cyan dots at every other pixel in the carry direction. For example, the nozzle #1 discharges cyan ink whenever it faces the second, fourth, sixth, . . . rasters, and forms cyan dots at every other pixel in the carry direction. In this way, an odd-numbered nozzle in the second cyan nozzle row (C2) forms cyan dots at pixels in the even-numbered rasters, but does not form cyan dots at pixels in the odd-numbered rasters that the second cyan nozzle row (C2) next faces. On the other hand, an even-numbered nozzle in the second cyan nozzle row (C2) discharges cyan ink whenever it faces odd-numbered rasters and forms cyan dots at every other pixel in the carry direction. For example, the nozzle #2 discharges cyan ink whenever it faces the first, third, fifth, . . . rasters, and forms cyan dots at every other pixel in the carry direction. In this way, an even-numbered nozzle in the second cyan nozzle row (C2) forms a cyan dot at the corresponding pixel in an odd-numbered raster, but does not form a dot at the corresponding pixel in the even-numbered raster that the second cyan nozzle row (C2) next faces.

As shown in FIG. 7C, an odd-numbered nozzle in the yellow nozzle row (Y) discharges yellow ink whenever it faces odd-numbered rasters and forms yellow dots at every other pixel in the carry direction. For example, the nozzle #1 discharges yellow ink whenever it faces the first, third, fifth, . . . rasters, and forms yellow dots at every other pixel in the carry direction. In this way, an odd-numbered nozzle forms a yellow dot at the corresponding pixel in an odd-numbered raster, but does not form a dot at the corresponding pixel in the even-numbered raster that the yellow nozzle row (Y) next faces. On the other hand, an even-numbered nozzle in the yellow nozzle row (Y) discharges yellow ink whenever it faces even-numbered rasters and forms yellow dots at every other pixel in the carry direction. For example, the nozzle #2 discharges yellow ink whenever it faces the second, fourth, sixth, . . . rasters, and forms yellow dots at every other pixel in the carry direction. That is, the yellow nozzle row (Y) forms yellow dots in the same arrangement as that of the cyan dots formed by the first cyan nozzle row (C1). In this way, an even-numbered nozzle forms a yellow dot at the corresponding pixel in an even-numbered raster, but does not form a dot at the corresponding pixel in the odd-numbered raster that the yellow nozzle row (Y) next faces.

Cyan dots disposed in the carry direction are now considered. To form cyan dots at pixels disposed in the carry direction, the first cyan nozzle row (C1) forms cyan dots at every other pixel in the carry direction, whereas the second cyan nozzle row (C2) forms cyan dots at every other pixel so as to be interleaved between the cyan dots that have been formed by the first cyan nozzle row at every other pixel in the carry direction. In this way, the cyan dots formed by the first cyan nozzle row (C1) and the cyan dots formed by the second cyan nozzle row (C2) are alternately disposed in the carry direction, so that the cyan ink can be applied without any gap. If the cyan dots formed by the first cyan nozzle row (C1) and the cyan dots formed by the second cyan nozzle row (C2) are formed in such a way that they are superimposed on the same respective pixels, there will be gaps where no cyan ink is applied, so that the surface of paper will likely be visible even when it is intended to fill the sheet only with cyan.

The relationship between cyan dots and yellow dots disposed in the carry direction is now considered. As seen from FIGS. 7A and 7C, yellow dots are formed in such a way that they are superimposed on the cyan dots that have been formed by the first cyan nozzle row (C1). The reason for this is that when the yellow nozzle row faces pixels at which cyan dots have been formed, the ink of the cyan dots formed by the first cyan nozzle row (C1) has been more absorbed in the sheet of paper and hence more dried than the ink of the cyan dots formed by the second cyan nozzle row (C2).

Nozzle design imposes a limit on the cycle in which a nozzle can discharge ink droplets in succession (discharge cycle). If the nozzle is designed to form dots at successive pixels in the carry direction, the travel of the sheet of paper during the discharge cycle can only be set to a value equal to one pixel, resulting in a slower carry speed and hence a slower printing speed. In contrast, in the first embodiment, since each nozzle forms dots at every other pixel in the carry direction, the travel of the sheet of paper during the discharge cycle can be set to a value equal to two pixels, allowing the printing speed to be faster.

According to the first embodiment described above, the first cyan nozzle row (C1) forms cyan dots in a checkerboard pattern (see FIG. 7A), and the second cyan nozzle row (C2) forms cyan dots in a checkerboard pattern so as to be interleaved between the cyan dots that have been formed by the first cyan nozzle row (C1) (see FIG. 7B). As a result, cyan dots are formed at all the pixels. On the other hand, only one yellow nozzle row forms yellow dots in a checkerboard pattern (see FIG. 7C), so that yellow dots are not formed at all the pixels (see FIG. 6). The reason for this is described below.

Since a yellow dot has a lighter color than those of cyan and magenta dots, a yellow dot has lower visibility (the dot is less noticeable). Therefore, even when the resolution of yellow dots is set to be lower than those of cyan and magenta dots, the image quality is not greatly affected. That is, the necessity to dispose yellow dots at high density (high resolution) is low. In contrast, since cyan and magenta dots have deeper colors than that of a yellow dot, cyan and magenta dots have higher visibility (these dots are more noticeable). Therefore, the resolutions of cyan and magenta dots greatly affect the image quality of a printed image. In particular, when some pixels in an image are filled with ink (filled image), higher resolutions of cyan and magenta dots allow the edge of the filled image to be more easily observed and hence the image quality to be improved. In this embodiment in which there is no black nozzle row, the three CMY inks are used to print an image filled in black. In this case as well, the resolutions of cyan and magenta dots greatly affect the visibility of the edge of the image filled in black, whereas the resolution of yellow dots does not greatly affect the visibility. When a black character is printed as well, higher resolutions of cyan and magenta dots allow the edge of the character and hence the character to be more easily observed. That is, the necessity to dispose relatively deeper colored dots, such as cyan and magenta dots, at high density (high resolution) is high. For these reasons, yellow dots are formed in a checkerboard pattern, whereas cyan and magenta dots are formed at all pixels.

In this embodiment, where D (=1/1600 inch) is the dot-to-dot distance (resolution) between adjacent cyan dots (or magenta dots) in the carry direction, the dot-to-dot distance between adjacent yellow dots in the carry direction is 2×D. Similarly, where D (=1/1600 inch) is the dot-to-dot distance between adjacent cyan dots in the sheet width direction, the dot-to-dot distance between adjacent yellow dots in the sheet width direction is 2×D. The dot-to-dot distance between the closest cyan dots is D, and the dot-to-dot distance between the closest yellow dots is approximately 1.41×D. In this embodiment, the resolution for yellow is thus lower than that for cyan.

In this embodiment, since yellow dots may be formed in a checkerboard pattern and may not be formed at all pixels, the number of yellow nozzle rows can be smaller than that of cyan nozzle rows. Therefore, the number of nozzle rows in the head unit can be smaller in the first embodiment than that in the case where the number of yellow nozzle rows is equal to that of cyan nozzle rows, allowing reduction in manufacturing cost.

In the first embodiment, the size of a yellow dot is larger than that of a cyan dot. The reason for this is described below.

Since a yellow dot has a lighter color than that of a cyan dot, a yellow dot has lower visibility (the dot is less noticeable). Therefore, a larger yellow dot will not likely worsen the granularity of a printed image. On the other hand, in this embodiment, since yellow dots are not formed at all pixels but formed in a checkerboard pattern, the size of each yellow dot is desirably as large as possible in order to apply the yellow ink as much as possible on the surface of the sheet of paper in such a dot arrangement. In contrast, since a cyan dot has higher visibility (the dot is more noticeable), a larger cyan dot will worsen the granularity of a printed image. On the other hand, in this embodiment, since cyan dots are formed at all pixels, even when the size of each cyan dot is reduced to a certain extent, cyan ink can be applied without any gap. Therefore, the size of each cyan dot is desirably as small as possible. For these reasons, the size of a yellow dot is larger than that of a cyan dot in the first embodiment.

Magenta

Two nozzle rows (M1 and M2) are prepared for magenta as in the case of cyan (see FIGS. 4A and 4B). The two magenta nozzle rows form dots in the same manner as the two cyan nozzle rows do. That is, the first magenta nozzle row (M1) forms magenta dots in a checkerboard pattern, and the second magenta nozzle row forms magenta dots in a checkerboard pattern so as to be interleaved between the magenta dots that have been formed in the checkerboard pattern by the first magenta nozzle row. In this way, when a certain nozzle discharges ink, the adjacent nozzles can be restricted not to discharge ink, so that the problem of crosstalk between nozzles will not occur. Further, in such a configuration, since each nozzle forms dots at every other pixel in the carry direction, the travel of the sheet of paper during the discharge cycle can be set to a value equal to two pixels, allowing the printing speed to be faster.

The first magenta nozzle row (M1) forms magenta dots in such a way that they are superimposed on the cyan dots that have been formed by the first cyan nozzle row (C1). The reason for this is that when the first magenta nozzle row faces the pixels at which cyan dots have been formed, the ink of the cyan dots formed by the first cyan nozzle row (C1) has been more absorbed in the sheet of paper and hence more dried than the ink of the cyan dots formed by the second cyan nozzle row (C2).

Second Embodiment

Figure 8:
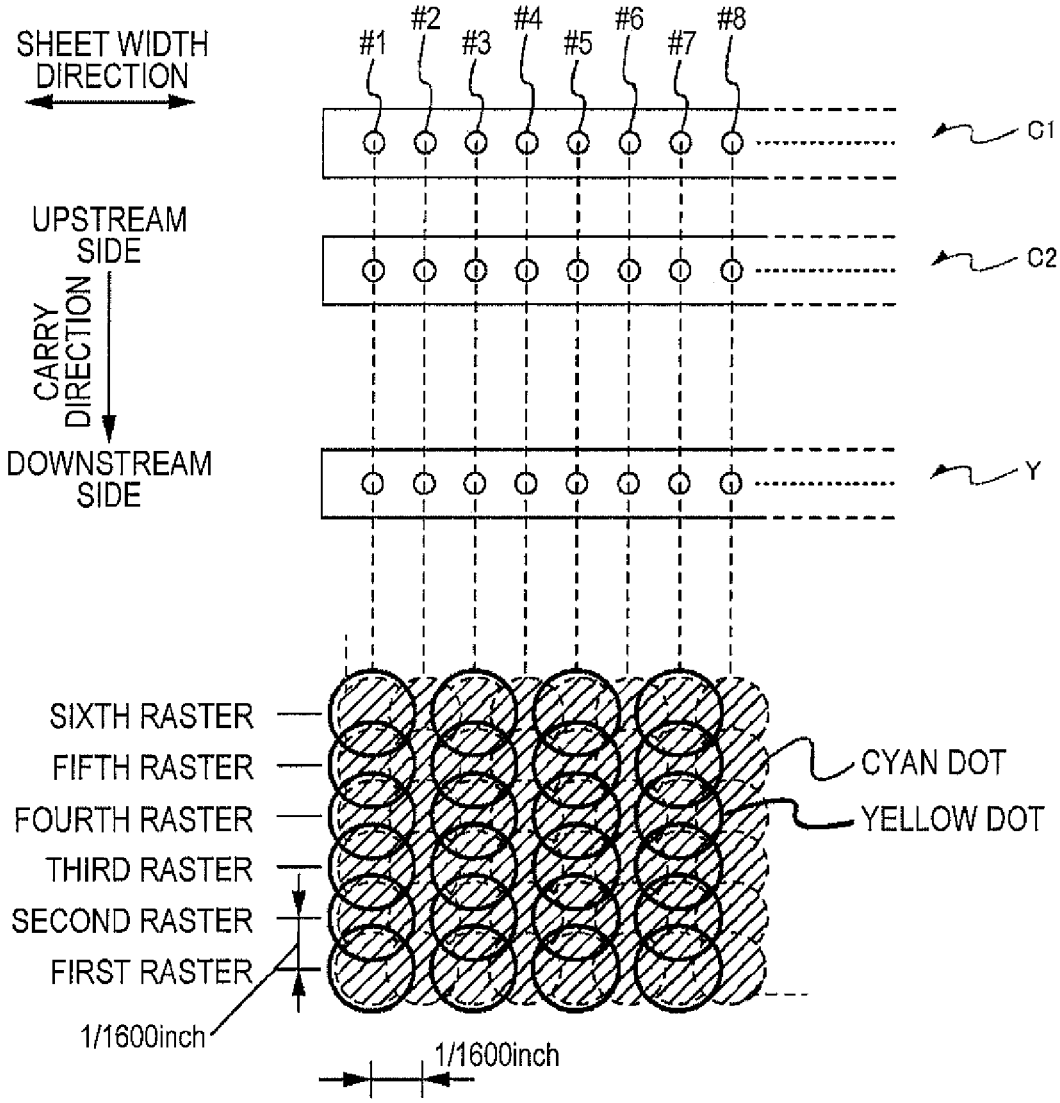
FIG. 8 is an explanatory diagram of a dot forming method according to a second embodiment of the invention.
Figure 9A:
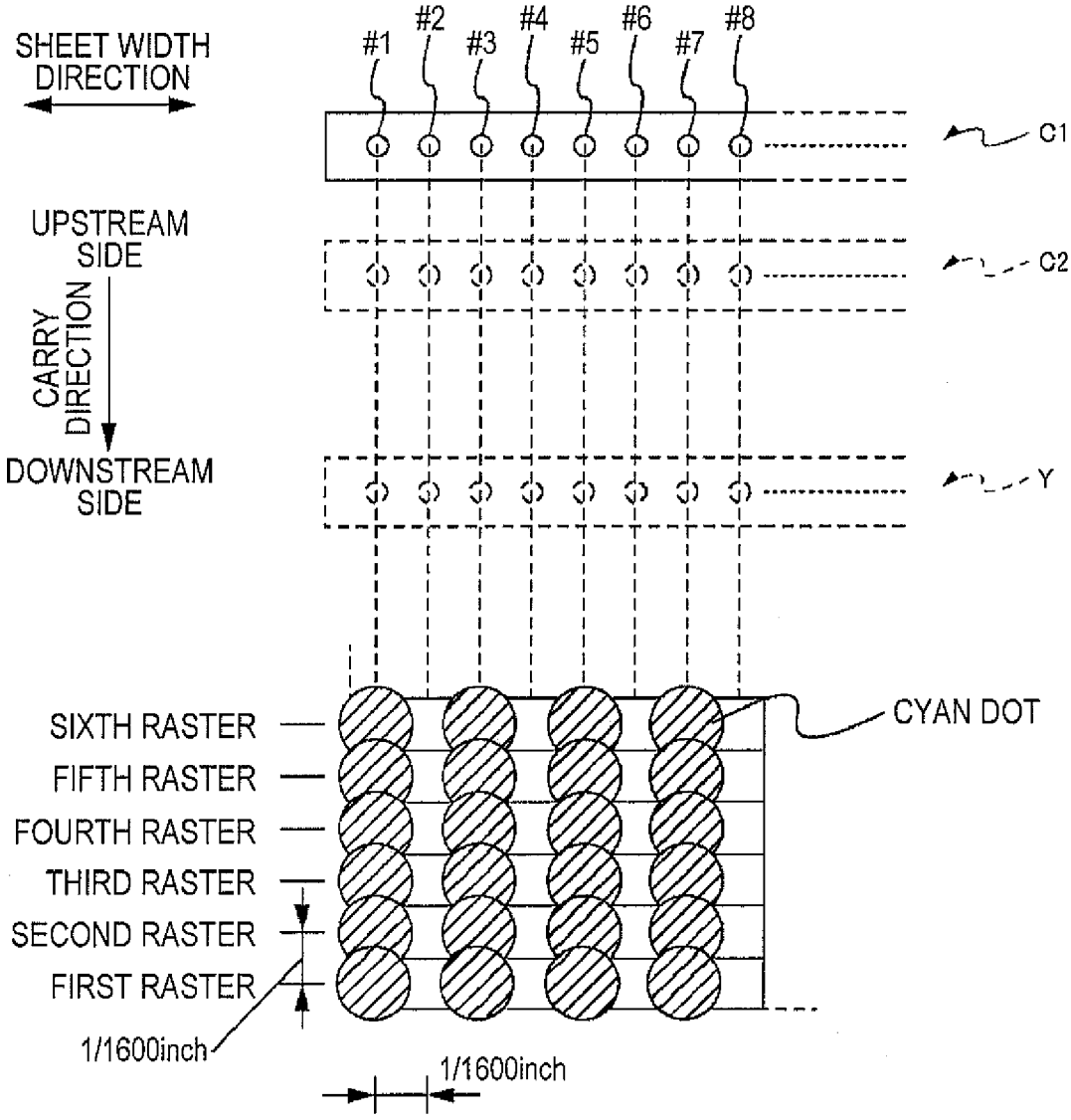
FIG. 9A is an explanatory diagram of a cyan dot forming method with the first cyan nozzle row in the second embodiment.
Figure 9B:
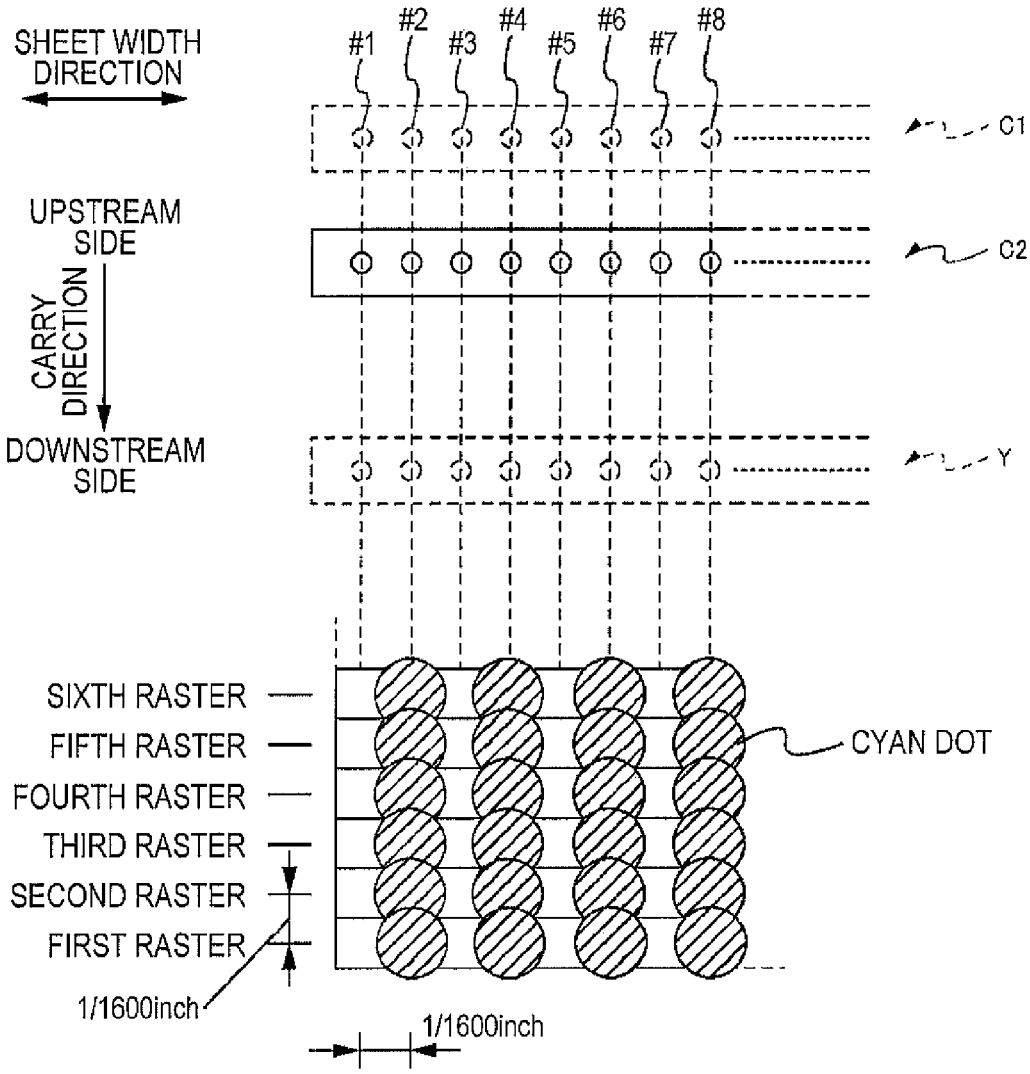
FIG. 9B is an explanatory diagram of a cyan dot forming method with the second cyan nozzle row in the second embodiment.
Figure 9C:
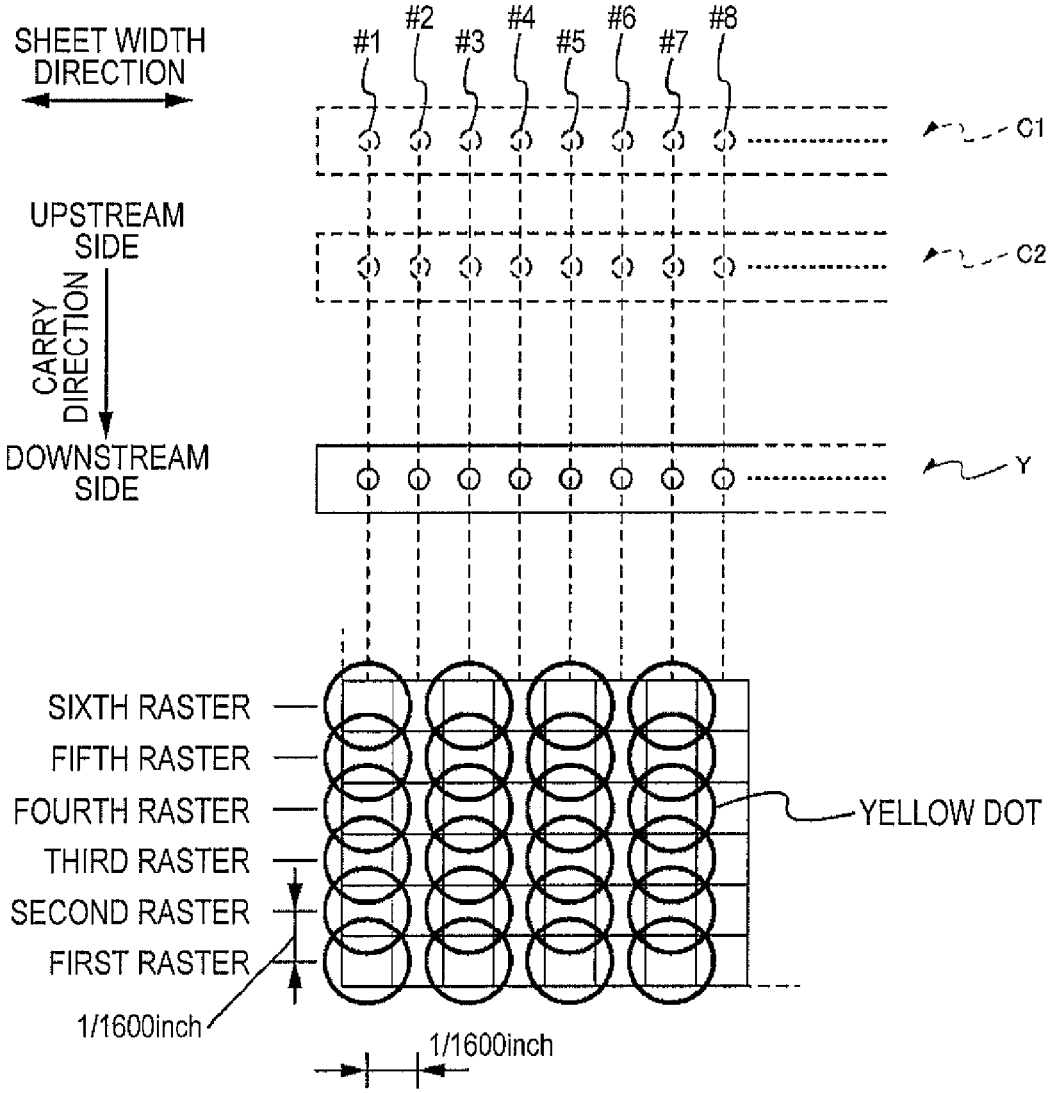
FIG. 9C is an explanatory diagram of a yellow dot forming method with the yellow nozzle row in the second embodiment.

FIG. 8 explains how to form dots in a second embodiment. FIG. 9A explains how to use the first cyan nozzle row to form cyan dots in the second embodiment. FIG. 9B explains how to use the second cyan nozzle row to form cyan dots in the second embodiment. FIG. 9C explains how to use the yellow nozzle row to form yellow dots in the second embodiment.

As shown in FIG. 9A, when the first cyan nozzle row (C1) faces each raster, cyan ink is discharged from the odd-numbered nozzles in the first cyan nozzle row, so that cyan dots are formed at the odd-numbered pixels. As shown in FIG. 9B, when the second cyan nozzle row (C2) faces each raster, cyan ink is discharged from the even-numbered nozzles in the second cyan nozzle row, so that cyan dots are formed at the even-numbered pixels. As shown in FIG. 9C, when the yellow nozzle row (Y) faces each raster, yellow ink is discharged from the odd-numbered nozzles in the yellow nozzle row, so that yellow dots are formed at the odd-numbered pixels. In this way, each of the nozzle rows discharges ink from either the set of odd-numbered nozzles or the set of even-numbered nozzles, and discharges no ink from the other set, so that no ink is discharged from adjacent nozzles. The problem of the crosstalk between nozzles will therefore not occur.

In the second embodiment as well, since yellow dots may not be formed at all pixels, the number of yellow nozzle rows can be smaller than that of cyan nozzle rows. Therefore, the number of nozzle rows in the head unit can be smaller in the second embodiment than in the case where the number of yellow nozzle rows is equal to that of cyan nozzle rows, allowing reduction in manufacturing cost.

However, in the second embodiment, the first cyan nozzle row and the second cyan nozzle row form dots at successive pixels in the carry direction. The yellow nozzle row also forms dots at successive pixels in the carry direction. Therefore, the travel of the sheet of paper during the discharge cycle can only be set to a value equal to one pixel, resulting in a slower carry speed and hence a slower printing speed in the second embodiment than in the first embodiment.

Third Embodiment

Figure 10:
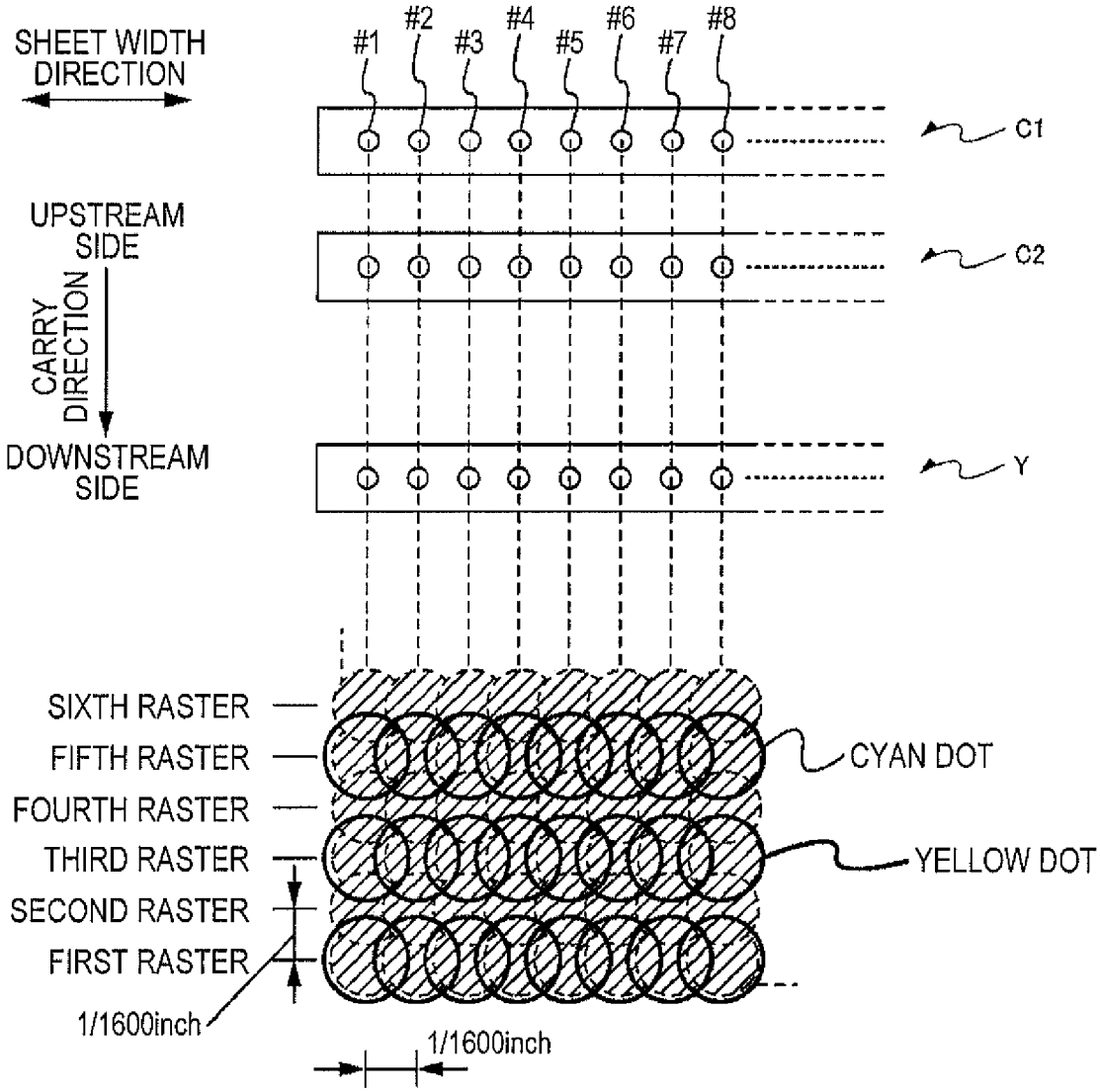
FIG. 10 is an explanatory diagram of a dot forming method according to a third embodiment of the invention.
Figure 11A:
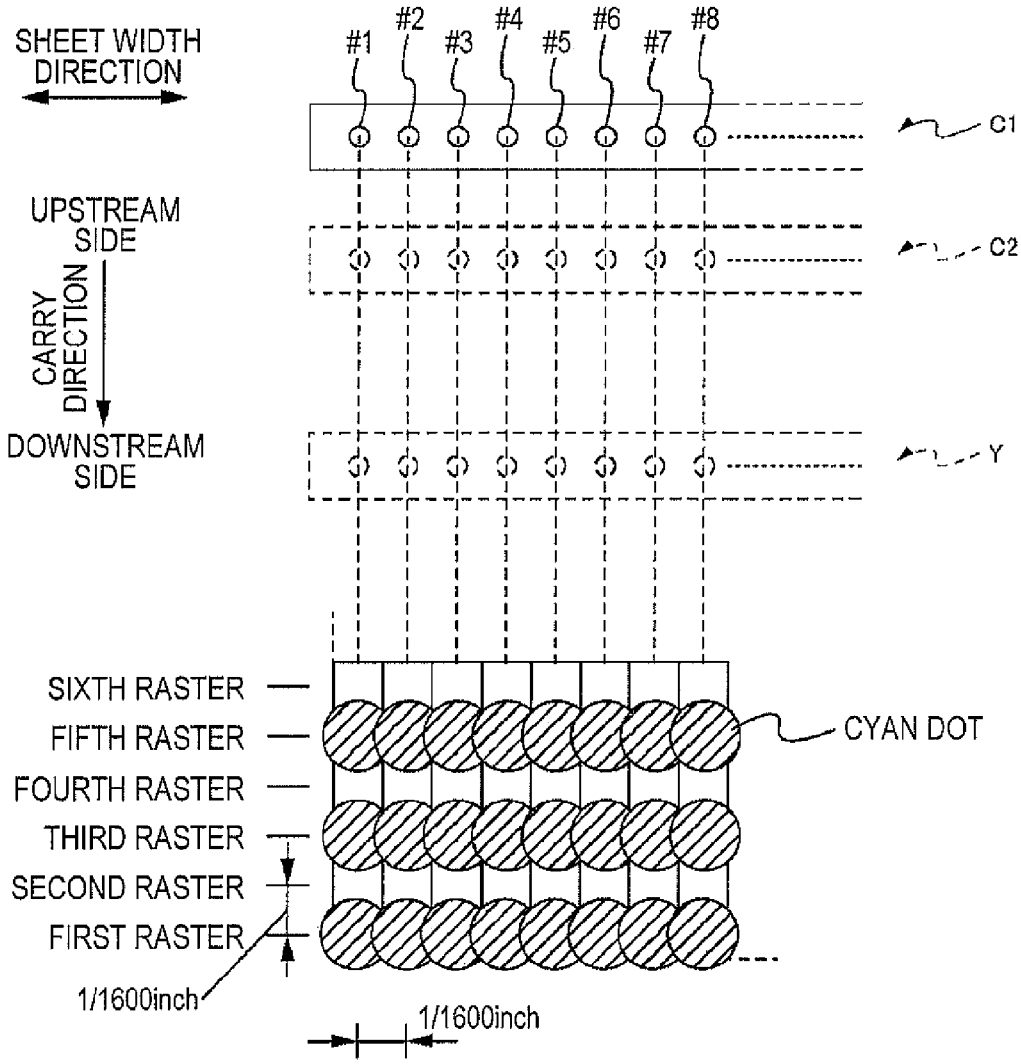
FIG. 11A is an explanatory diagram of a cyan dot forming method with the first cyan nozzle row in the third embodiment.
Figure 11B:
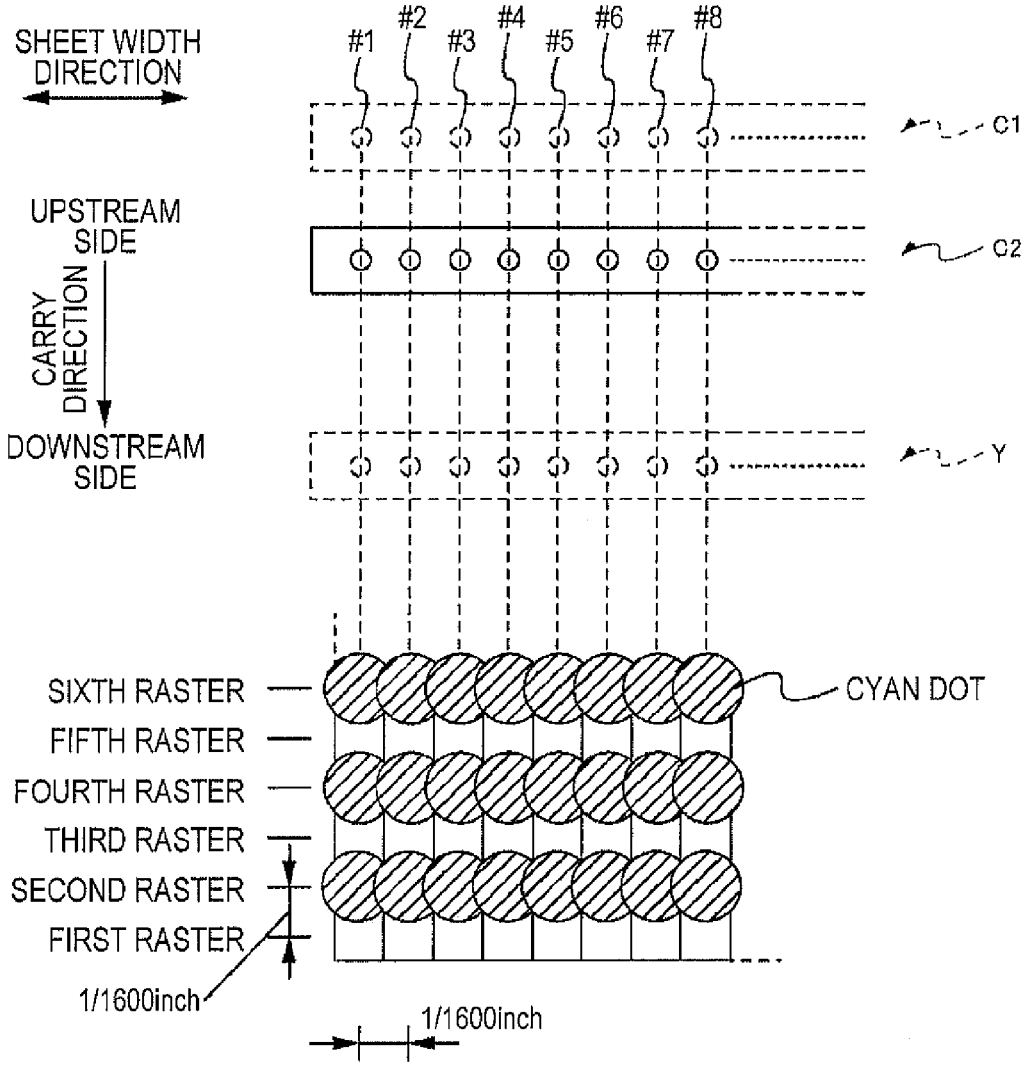
FIG. 11B is an explanatory diagram of a cyan dot forming method with the second cyan nozzle row in the third embodiment.
Figure 11C:
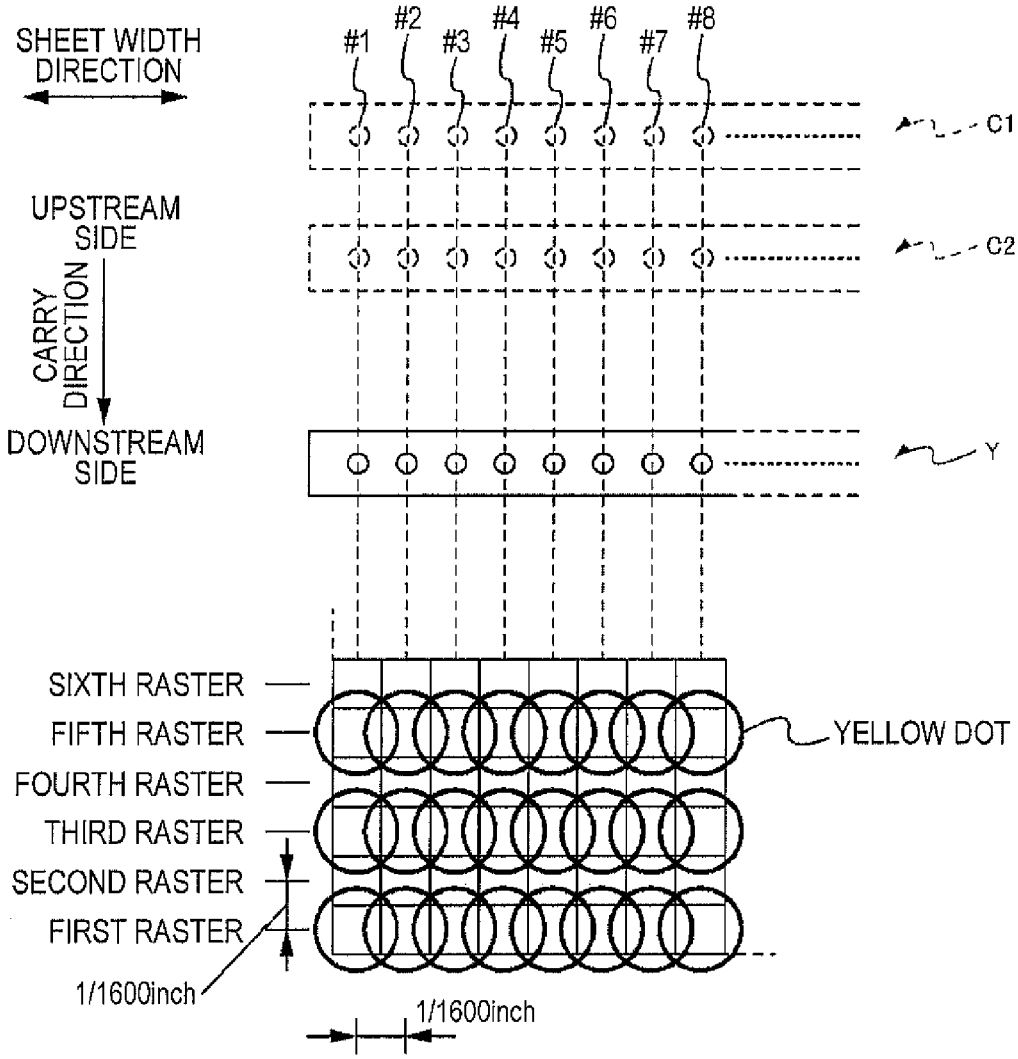
FIG. 11C is an explanatory diagram of a yellow dot forming method with the yellow nozzle row in the third embodiment.

FIG. 10 explains how to form dots in a third embodiment. FIG. 11A explains how to use the first cyan nozzle row to form cyan dots in the third embodiment. FIG. 11B explains how to use the second cyan nozzle row to form cyan dots in the third embodiment. FIG. 11C explains how to use the yellow nozzle row to form yellow dots in the third embodiment.

As shown in FIG. 11A, the nozzles in the first cyan nozzle row (C1) discharge cyan ink when they face an odd-numbered raster, whereas the nozzles do not discharge cyan ink when they face an even-numbered raster, so that cyan dots are formed at every other raster. As shown in FIG. 11B, the nozzles in the second cyan nozzle row (C2) discharge cyan ink when they face an even-numbered raster, whereas the nozzles do not discharge cyan ink when they face an odd-numbered raster, so that cyan dots are formed at every other raster. As shown in FIG. 11C, the nozzles in the yellow nozzle row (Y) discharge yellow ink when they face an odd-numbered raster, whereas the nozzles do not discharge yellow ink when they face an even-numbered raster, so that yellow dots are formed at every other raster. Since each nozzle thus forms dots at every other pixel in the carry direction, the travel of the sheet of paper during the discharge cycle can be set to a value equal to two pixels, allowing the printing speed to be faster.

In the third embodiment as well, since yellow dots may not be formed at all pixels, the number of yellow nozzle rows can be smaller than that of cyan nozzle rows. Therefore, the number of nozzle rows in the head unit can be smaller in the third embodiment than in the case where the number of yellow nozzle rows is equal to that of cyan nozzle rows, allowing reduction in manufacturing cost.

In the third embodiment, however, since adjacent nozzles also discharge ink, the problem of the crosstalk between nozzles will occur.

Comparative Example

Figure 12A:
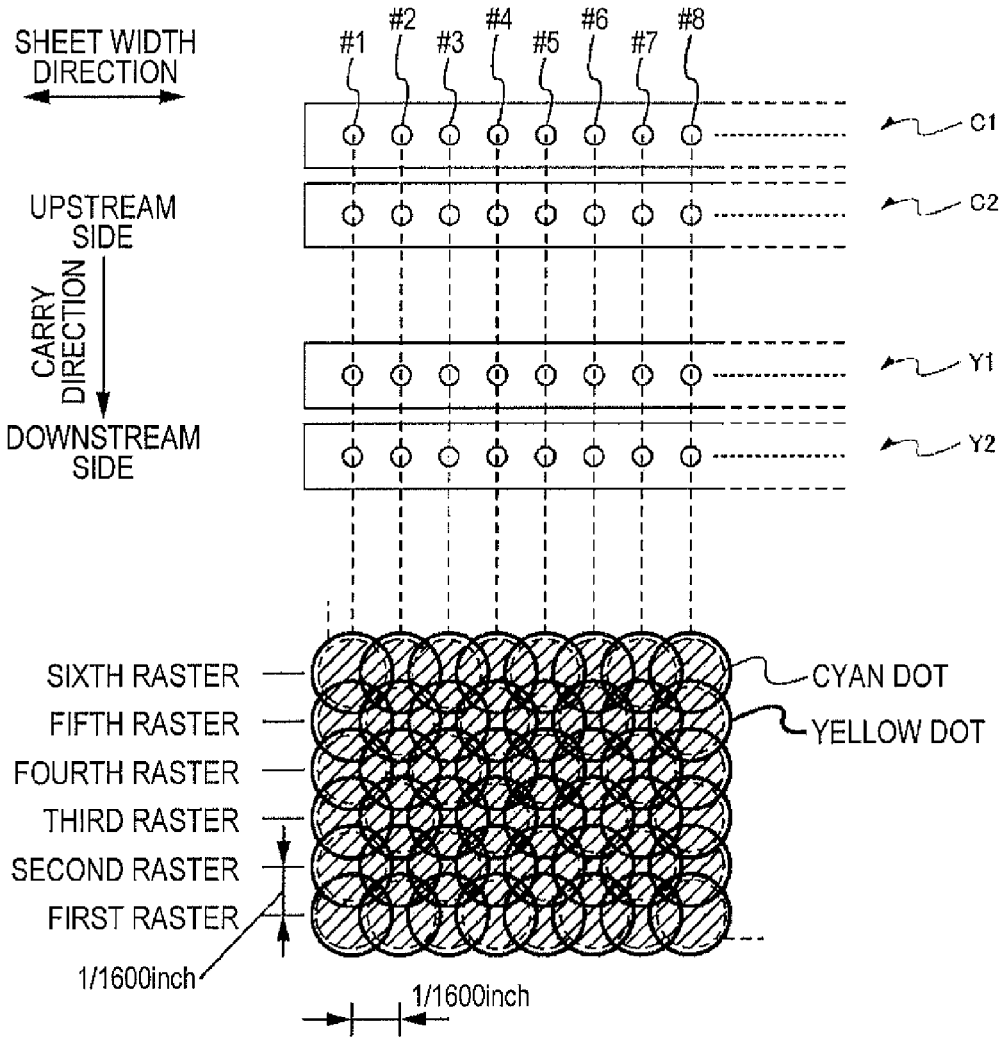
FIG. 12A is an explanatory diagram of a dot forming method of a comparative example.
Figure 12B:
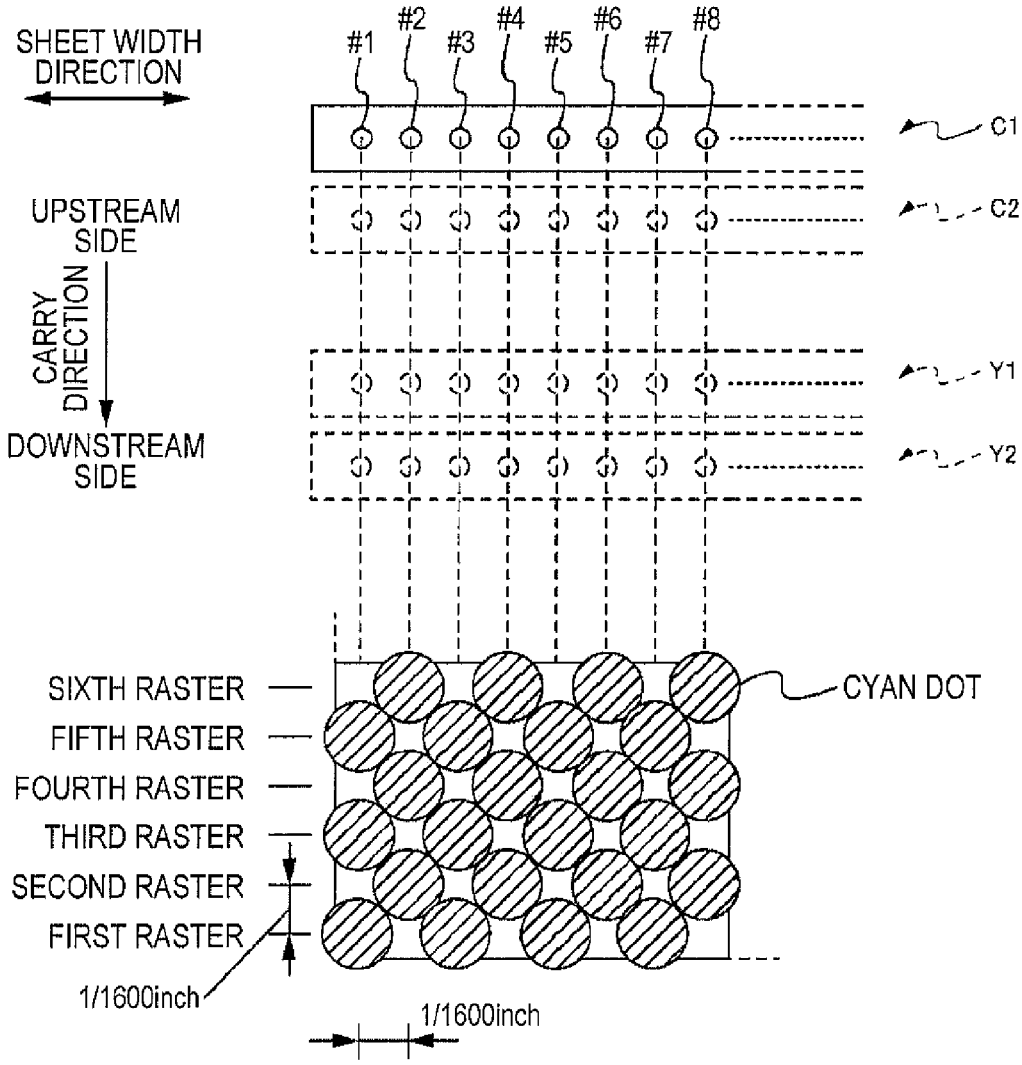
FIG. 12B is an explanatory diagram of a cyan dot forming method in the comparative example.
Figure 12C:
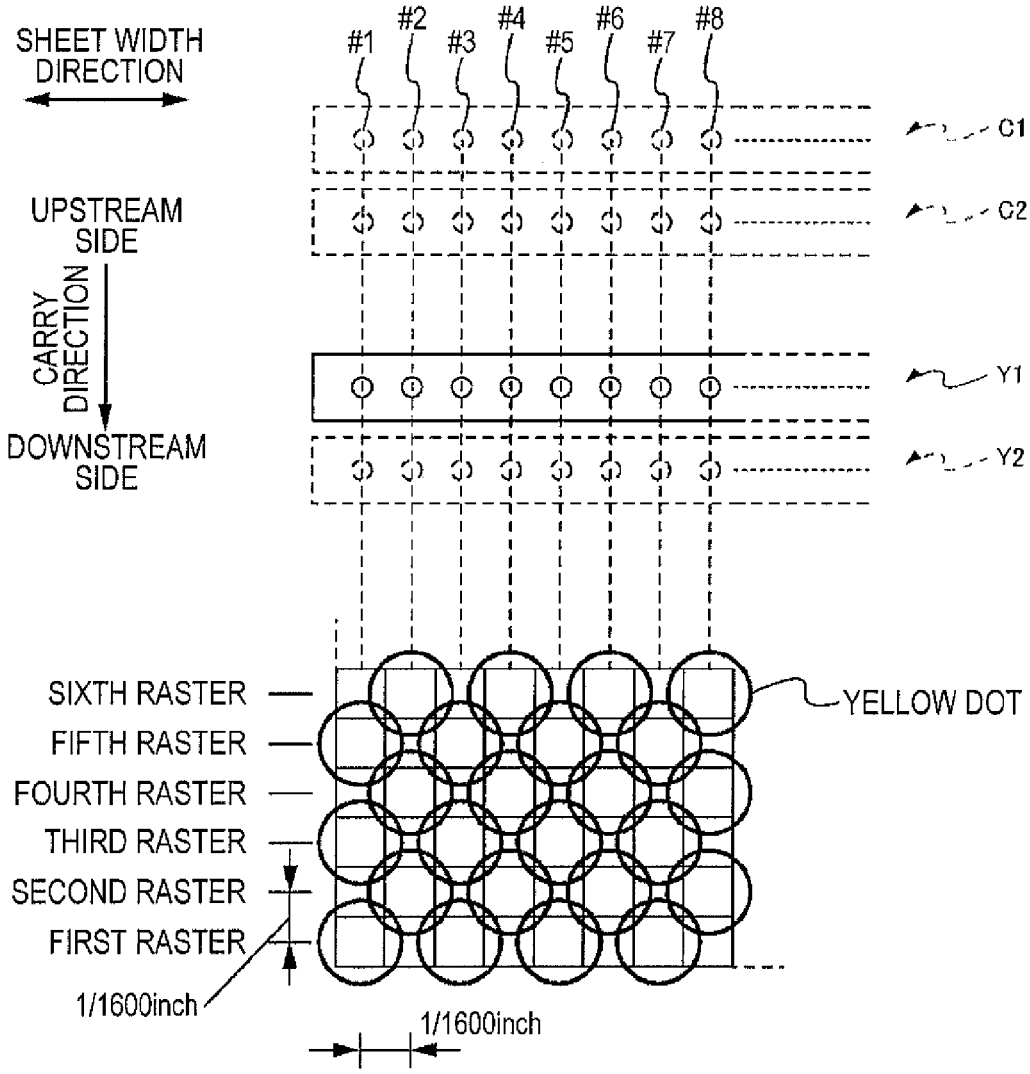
FIG. 12C is an explanatory diagram of a yellow dot forming method in the comparative example.

FIG. 12A explains how to form dots in a comparative example. FIG. 12B explains how to form cyan dots in the comparative example. FIG. 12C explains how to form yellow dots in the comparative example. In the comparative example as well, the largest number of dots are formed in each of the figures.

The comparative example differs from the first to third embodiments in that the number of cyan nozzle rows is the same as that of yellow nozzle rows (in the first to third embodiments, the number of yellow nozzle rows is smaller than that of cyan nozzle rows).

In the comparative example, when the largest number of dots are formed, cyan and yellow dots are formed at all pixels. To form dots in this manner, two cyan nozzle rows are used to form cyan dots at all pixels. Specifically, a first cyan nozzle row (C1) forms cyan dots in a checkerboard pattern as shown in FIG. 12B, and a second cyan nozzle row (C2) forms cyan dots at the remaining pixels in a checkerboard pattern. Similarly, in the comparative example, two yellow nozzle rows are used to form yellow dots at all pixels. Specifically, a first yellow nozzle row (Y1) forms yellow dots in a checkerboard pattern as shown in FIG. 12C, and a second yellow nozzle row (Y2) forms yellow dots at the remaining pixels in a checkerboard pattern.

Since two cyan nozzle rows and two yellow nozzle rows are prepared in the comparative example, the number of nozzle rows in the head unit is greater than in the case where the number of yellow nozzle rows is reduced in the above embodiments, disadvantageously resulting in increase in manufacturing cost.

Other Embodiments

While a printer and the like have been described as one embodiment, the above embodiments are presented to easily understand the invention, but not to construe the invention in a limiting sense. Alteration and modification can of course be made to the invention without departing from the spirit thereof, and such equivalents fall within the scope of the invention. In particular, the following embodiments fall within the scope of the invention.

Number of Nozzle Rows

In the above embodiments, the number of cyan nozzle rows is two, and the number of yellow nozzle rows is one. The number of nozzle rows, however, is not limited thereto. For example, the number of yellow nozzle rows may be two or more.

Figure 13:
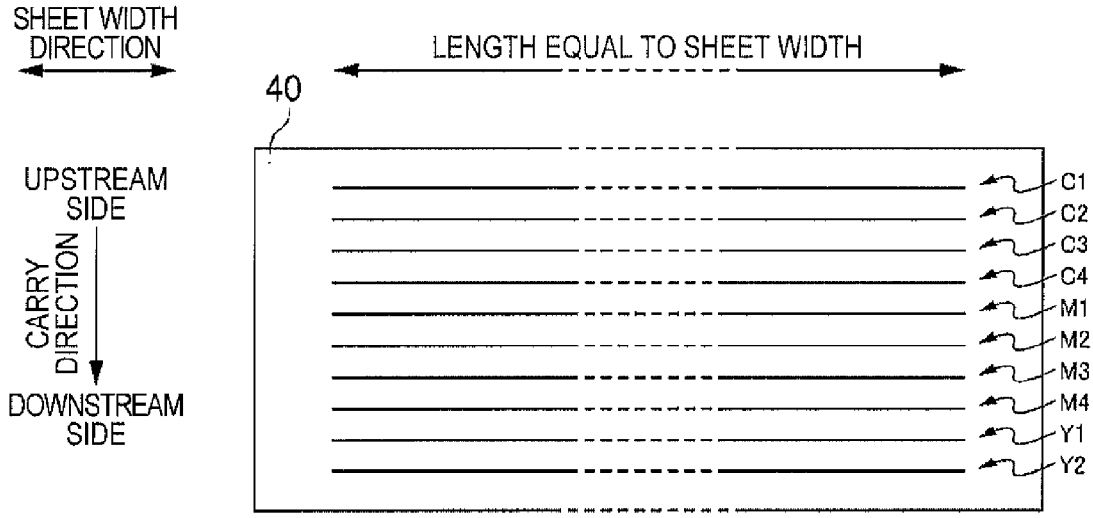
FIG. 13 is a top perspective view of an arrangement of a plurality of nozzle rows located on the underside of the head unit in another embodiment.

FIG. 13 is a top perspective view for explaining the arrangement of a plurality of nozzle rows located on the underside of the head unit 40 in another embodiment. Ten nozzle rows are provided on the underside of the head unit 40.

Four cyan nozzle rows are provided. Although not illustrated, each of a first cyan nozzle row (C1) and a second cyan nozzle row (C2) in this embodiment forms half the cyan dots formed by the first cyan nozzle row (C1) in the first embodiment (see FIG. 7A), and cyan nozzle rows (C1) and (C2) in this embodiment form the cyan dots in the checkerboard pattern formed by the first cyan nozzle row (C1) in the first embodiment. Similarly, a third cyan nozzle row (C3) and a fourth cyan nozzle row (C4) form the cyan dots in the checkerboard pattern formed by the second cyan nozzle row (C2) in the first embodiment (see FIG. 7E). Two yellow nozzle rows, a first yellow nozzle row (Y1) and a second yellow nozzle row (Y2) in this embodiment, form yellow dots in the checkerboard pattern formed by the yellow nozzle row (Y) in the first embodiment (see FIG. 7C). Each of the yellow nozzle rows forms yellow dots in the same arrangement as those of the cyan dots formed by the first cyan nozzle row (C1) and the second cyan nozzle row (C2).

In this embodiment as well, since yellow dots may not be formed at all pixels, the number of yellow nozzle rows can be smaller than that of cyan nozzle rows. Therefore, the number of nozzle rows in the head unit can be smaller than that in the case where the number of yellow nozzle rows is equal to that of cyan nozzle rows, allowing reduction in manufacturing cost.

Line Printer

In the above embodiments, a line printer is described that uses a nozzle row having a length equal to the width of a sheet of paper to discharge ink for printing while carrying the sheet of paper. However, the invention is not limited to a printer of this type, and is applicable to printers of another type.

Figure 14A:
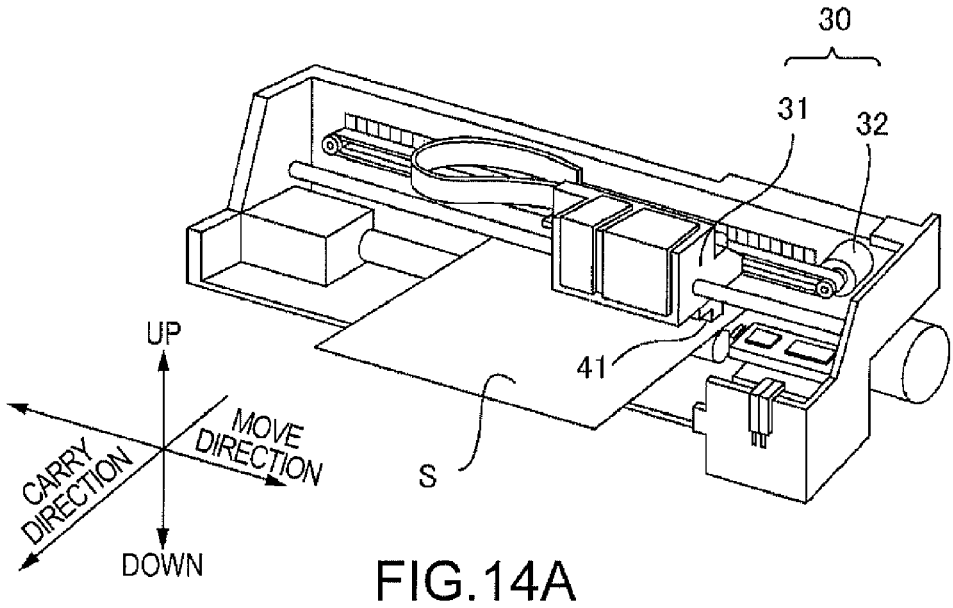
FIG. 14A is an explanatory diagram of another printer.

FIG. 14A explains such another printer. The printer includes a carriage unit 30 having a carriage 31 and a carriage motor 32. A head 41 is provided under the carriage.

Figure 14B:
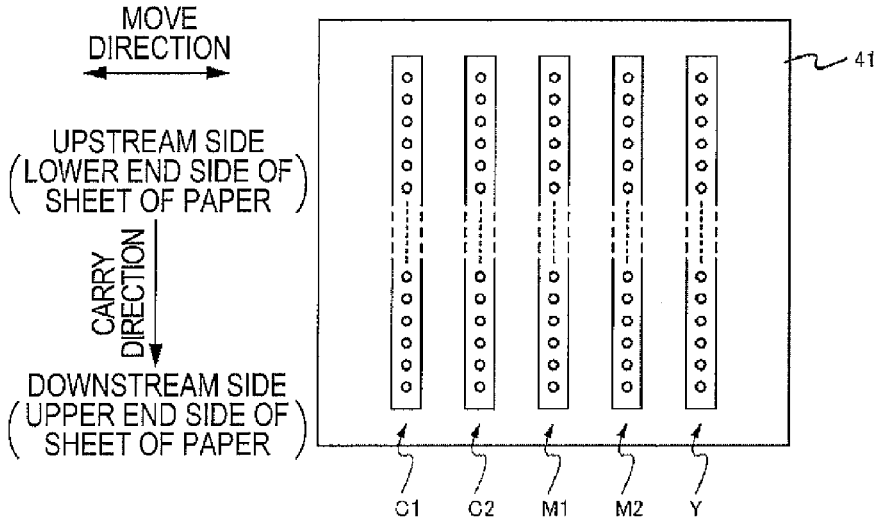
FIG. 14B is a top perspective view of an arrangement of a plurality of nozzle rows located on the underside of a head.

FIG. 14B is a top perspective view for explaining the arrangement of a plurality of nozzle rows located on the underside of the head 41. Five nozzle rows are provided on the underside of the head 41 along the move direction. The number of cyan nozzle rows is two, whereas the number of yellow nozzle rows is one. Each of the nozzle rows has a plurality of nozzles disposed at a predetermined nozzle pitch along the carry direction.

A controller (not shown) in the printer performs printing by alternately repeating a dot formation operation in which the carriage unit 30, a head unit including the head 41, and a carry unit are controlled to cause ink to be discharged from the nozzle rows that move in the move direction and a carry operation in which a sheet of paper is carried in the carry direction.

Figure 15:
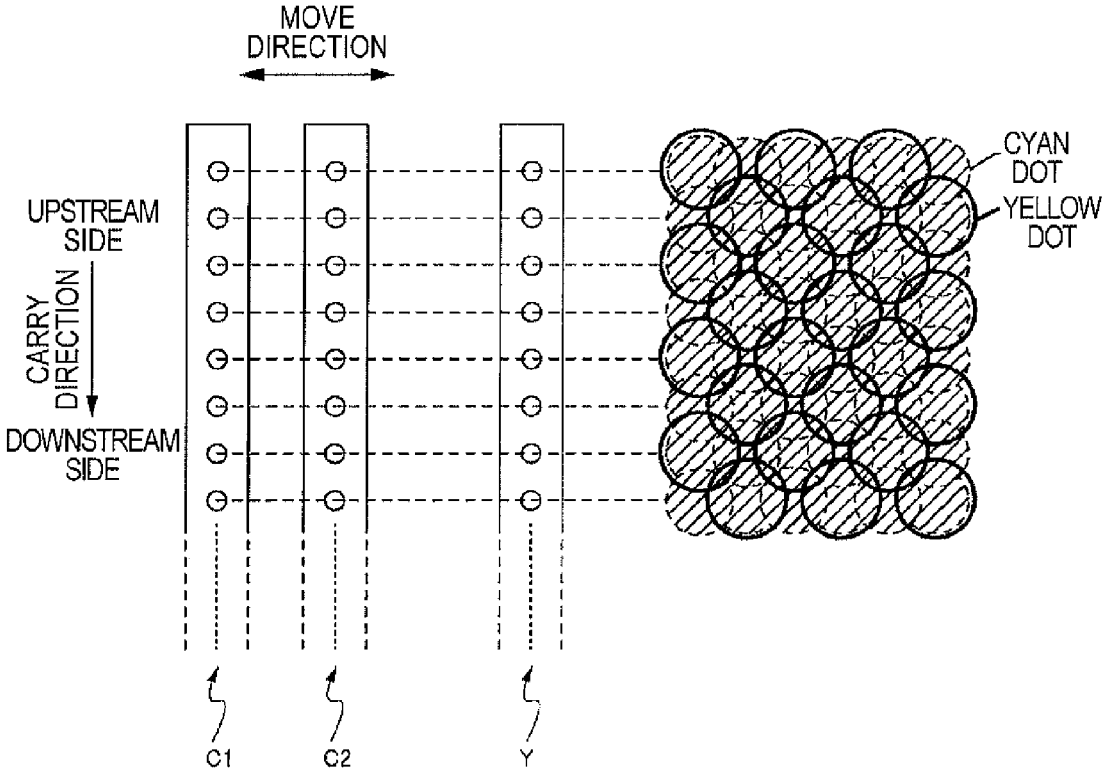
FIG. 15 is an explanatory diagram of a dot forming method in the other printer.

FIG. 15 explains how to form dots in this printer. FIG. 15 shows how the dot formation operation is performed during the carry operation. As shown in FIG. 15, the first cyan nozzle row (C1) forms cyan dots in a checkerboard pattern. The second cyan nozzle row (C2) forms cyan dots in a checkerboard pattern so as to be interleaved between the cyan dots that have been formed in the checkerboard pattern by the first cyan nozzle row (C1). The yellow nozzle row (Y) forms dots in a checkerboard pattern. In this way, the same advantageous effect as in the first embodiment can be provided.

Liquid Discharge Apparatus

In the above embodiments, the inkjet printer has been described as an example of the liquid discharge apparatus that discharges liquid. The liquid discharge apparatus, however, is not limited to a printer. For example, the invention may be applicable to various liquid discharge apparatuses to which inkjet technology is applied, such as color filter manufacturing apparatuses, dyeing apparatuses, micromachining apparatuses, semiconductor manufacturing apparatuses, surface machining apparatuses, three-dimensional modelers, liquid vaporization apparatuses, organic EL manufacturing apparatuses (in particular, polymer EL manufacturing apparatuses), display manufacturing apparatuses, film forming apparatuses, and DNA chip manufacturing apparatuses. Further, the manufacturing methods used in the above apparatuses also fall within the application of the invention.

Nozzle

In the above embodiments, a heater is used to discharge ink. However, the method for discharging liquid is not limited thereto. For example, other methods, such as a method in which a piezoelectric element is used to discharge ink, may be used.

What is claimed is:

1. A liquid discharge apparatus comprising:

a plurality of first nozzle rows, each including a plurality of nozzles disposed in a predetermined direction that discharge cyan or magenta first liquid;

second nozzle rows, each including a plurality of nozzles disposed in the predetermined direction that discharge yellow second liquid, the number of second nozzle rows being smaller than the number of first nozzle rows; and a controller that uses the plurality of first nozzle rows to form cyan or magenta first dots at pixels on a medium and uses the second nozzle rows to form yellow second dots at pixels whose number is smaller than the number of pixels at which the first dots have been formed.

2. The liquid discharge apparatus according to claim 1, wherein when a certain nozzle discharges liquid, nozzles adjacent to the certain nozzle do not discharge liquid.

3. The liquid discharge apparatus according to claim 1, wherein after a certain nozzle has formed a dot at a pixel, the nozzle does not form a dot at a pixel that the nozzle next faces.

4. The liquid discharge apparatus according to claim 1, wherein the plurality of first nozzle rows include two first nozzle rows, after one of the first nozzle rows has formed corresponding first dots, the other first nozzle row forms corresponding first dots, and the second nozzle rows form the second dots at pixels at which the one of the first nozzle rows has formed the corresponding first dots, and form no second dots at pixels at which the other first nozzle row has formed the corresponding first dots.

5. The liquid discharge apparatus according to claim 1, wherein the second dot is larger than the first dot.

6. A liquid discharge apparatus comprising:

a plurality of cyan nozzle rows, each including a plurality of nozzles disposed in a predetermined direction that discharge cyan ink;

a plurality of magenta nozzle rows, each including a plurality of nozzles disposed in the predetermined direction that discharge magenta ink;

yellow nozzle rows, each including a plurality of nozzles disposed in the predetermined direction that discharge yellow ink, the number of yellow nozzle rows being smaller than the number of cyan nozzle rows and the number of magenta nozzle rows; and a controller that uses the plurality of cyan nozzle rows to form cyan dots at pixels on a medium, uses the plurality of magenta nozzle rows to form magenta dots at pixels on the medium, and uses the yellow nozzle rows to form yellow dots at pixels whose number is smaller than the number of pixels at which the cyan dots have been formed and the number of pixels at which the magenta dots have been formed.

7. The liquid discharge apparatus according to claim 6, wherein when a certain nozzle discharges liquid, nozzles adjacent to the certain nozzle do not discharge liquid.

8. The liquid discharge apparatus according to claim 6, wherein after a certain nozzle has formed a dot at a pixel, the nozzle does not form a dot at a pixel that the nozzle next faces.

9. The liquid discharge apparatus according to claim 6, wherein the yellow dots are larger than the cyan and magenta dots.

10. A liquid discharge method comprising:

discharging cyan or magenta first liquid from first nozzle rows, each including a plurality of nozzles disposed in a predetermined direction;

discharging yellow second liquid from second nozzle rows, each including a plurality of nozzles disposed in the predetermined direction;

using the plurality of first nozzle rows to form cyan or magenta first dots at pixels on a medium; and using the second nozzle rows, the number of which is smaller than the number of first nozzle rows, to form yellow second dots at pixels whose number is smaller than the number of pixels at which the first dots have been formed.

11. The liquid discharge method according to claim 10, further comprising:

when a certain nozzle discharges liquid, not discharging liquid from nozzles adjacent to the certain nozzle.

12. The liquid discharge method according to claim 10, further comprising:

after a certain nozzle has formed a dot at a pixel, not forming a dot at a pixel that the nozzle next faces.

13. The liquid discharge method according to claim 10, wherein the plurality of first nozzle rows include two first nozzle rows, and further comprising:

after one of the first nozzle rows has formed corresponding first dots, forming corresponding first dots with the other first nozzle row, and with the second nozzle rows, forming the second dots at pixels at which the one of the first nozzle rows has formed the corresponding first dots, and forming no second dots at pixels at which the other first nozzle row has formed the corresponding first dots.

14. The liquid discharge method according to claim 10, and further comprising:

forming the second dot to be larger than the first dot.

* * * * *